US006883279B2

(12) United States Patent
Fukuro et al.

(10) Patent No.: US 6,883,279 B2
(45) Date of Patent: Apr. 26, 2005

(54) OUTDOOR WINDOW

(75) Inventors: Toshio Fukuro, Takaoka (JP); Hidenori Ueno, Takaoka (JP); Ryou Yashiki, Takaoka (JP)

(73) Assignee: Tateyama Aluminum Industry Co., Ltd., Takaoka (JP)

( * ) Notice: Subject to any disclaimer, the term of this patent is extended or adjusted under 35 U.S.C. 154(b) by 0 days.

(21) Appl. No.: 10/391,947

(22) Filed: Mar. 19, 2003

(65) Prior Publication Data

US 2003/0177699 A1 Sep. 25, 2003

Related U.S. Application Data

(63) Continuation of application No. PCT/JP01/10411, filed on Nov. 28, 2001.

(30) Foreign Application Priority Data

Dec. 1, 2000 (JP) ..... 2000-366429
May 10, 2001 (JP) ..... 2001-140780

(51) Int. Cl.[7] ..... E06B 7/14

(52) U.S. Cl. ..... 52/209; 52/204.51; 49/408; 49/501; 49/467.1

(58) Field of Search ..... 52/207, 209, 204.51, 52/204.5, 204.597; 49/408, 453, 143, 501, 467.1, 471; 160/369; 4/557, 601

(56) References Cited

U.S. PATENT DOCUMENTS 4,042,004 A * 8/1977 Kwan ..... 160/91
4,431,228 A * 2/1984 Grise ..... 296/100.02
4,685,263 A * 8/1987 Ting ..... 52/235
5,560,149 A * 10/1996 Lafevre ..... 49/501
5,678,366 A * 10/1997 Nambo et al. ..... 52/207
5,956,909 A * 9/1999 Chou ..... 52/209
6,098,355 A * 8/2000 Li ..... 52/212
6,393,778 B1 * 5/2002 Ting ..... 52/204.5

FOREIGN PATENT DOCUMENTS

| | | | |
|---|---|---|---|
| JP | 49-11380 | | 3/1974 |
| JP | 57-185894 | | 11/1982 |
| JP | 62-69589 | | 5/1987 |
| JP | 62-33393 | | 7/1987 |
| JP | 3-68285 | | 7/1991 |
| JP | 4-23190 | | 5/1992 |
| JP | 2573206 | | 5/1998 |
| JP | 10-227184 | A1 | 8/1998 |
| JP | 11-81806 | * | 3/1999 |
| JP | 2000-96934 | A | 4/2000 |
| JP | 2000-186472 | * | 7/2000 |

* cited by examiner

*Primary Examiner*—Winnie Yip
(74) *Attorney, Agent, or Firm*—Burr & Brown

(57) ABSTRACT

The outdoor window includes a sealing member provided between each sliding sash and sill so that a sealing portion is pressed when a wind pressure is applied to the sliding sashes from the outdoor side, drain grooves provided on a top surface of the sill, water collecting grooves having a width wider than the width of the drain grooves and being provided immediately below the drain groove, drain ports provided at a bottom of the water collecting grooves; a guiding hollow portion provides immediately below the drain ports for guiding rainwater outdoors, and an outdoor drain port provided at an outdoor side of the guiding hollow portion. The water collecting grooves and the guiding hollow portion communicate with outside air.

4 Claims, 20 Drawing Sheets

FIG. 1

| △P (P1-P2)[Pa] | Q [ml/min] | AO [mm²] | X1 | | X2 | |
|---|---|---|---|---|---|---|
| | | | V1 [mm³] | A1 [mm²] | V2 [mm³] | A2 [mm²] |
| 0 | 350 | 5050 | 8900 | 980 | 508000 | 1150 |
| 150 | 780 | 5050 | 138800 | 1690 | 994000 | 1910 |
| 250 | 1150 | 5050 | 192000 | 2470 | 1440000 | 2650 |
| 350 | 1650 | 5050 | 269200 | 3590 | 2016000 | 3650 |
| 500 | 2500 | 5050 | 396000 | 5130 | 2880000 | 5300 |

※ W=1800

OUT
IN
53
63a
63
53a
71
72
66
90
91
91a
92
61a
80

OUTDOOR WINDOW

This application is a continuation of International Application No. PCT/JP01/10411, having an international filing date of Nov. 28, 2001, which designated the United States, the entirety of which is incorporated herein by reference. This application also claims the benefit of Japanese Patent Application No. 2000-366429 filed on Dec. 1, 2000, and Japanese Patent Application No. 2001-140780 filed on May 10, 2001, and are hereby incorporated by reference in their entirety.

BACKGROUND OF THE INVENTION

The present invention relates to a window which is installed in an outdoor opening of a building, and more particularly, to an outdoor window having an approximately flat top surface on a sill. This window is superior in drainage from the flat top surface and is superior in airtightness and watertightness on an indoor side even during a rain storm when the top surface on the sill is formed to be flat.

A barrier free structure in which steps are eliminated from the doorways of rooms and the doorway of a bathroom in a house or the like is publicly known.

However, in the case where a window which is installed in an outdoor opening of a building is formed as a merely flat structure in which projecting rails are eliminated from the top surface of an existing projecting-rail type of sill (refer to FIG. 20) to simply eliminate steps which would have been disposed in the direction in which a person goes in or out, there is a high risk that a large amount of rainwater which blows on a sliding sash or the like under a large wind pressure during a rain storm flows onto that flat surface and rainwater enters an indoor side together with a flow of wind. On the other hand, in the case where a groove is provided on the flat surface of a sill and a large drain space is provided below the groove, it is impossible to ensure strength and rigidity enough to support the weight of a door or the weight of a person who goes in and out. In addition, very strict quality standards are specified under Japanese Industrial Standards. For example, the quality standard of an outdoor opening window that is specified under Japanese Industrial Standards is very strict as follows: at a test class of 50 grades, water is not allowed to leak into an indoor side when water is sprayed at a rate of 4 liters/square meter per minute while a wind pressure is being applied in the form of a pulsating pressure which is a maximum of 750 Pa and a minimum of 250 Pa and an average pressure difference of 500 Pa (this test will be hereinafter referred to a 500-Pa grade test). Therefore, a barrier free outdoor opening has been considered to be difficult to realize.

For example, Japanese Utility Model Application Laid-Open No. 3-68285 discloses an example in which the top surface of the sill (a portion on which double sliding sashes run) of a window is formed to be approximately flat. This example merely aims at airtightness, and its constituent requirement is that tight materials be provided on the opposite sides of a projecting portion. As a result, the manipulating force required to move a sliding sash is increased by the resistance of the tight materials provided on the opposite sides, and in addition, since the tight materials provided on the opposite sides of the projecting portion hinder outside air from entering a groove in the sill, the difference between the pressure of outside air and the pressure of the groove portion of the sill becomes large, so that it is difficult to realize stable sealing along the entire length of the projecting portion. This leads to the technical problem that owing to such pressure difference, rainwater concentratively flows through a weakly sealed portion and enters an indoor side.

In addition, Japanese Patent Application Laid-Open No. 2000-96934 discloses an example in which a sill is formed to have a flat top surface from which projecting rails are eliminated, and a guide groove is provided on the top surface and a guide plate is extended vertically downwardly from the body of a fitting and is inserted in this groove (1).

However, the fact that the guide plate is tightly engaged with one peripheral end of the guide groove by using a C-shaped bottom guide with a C-shaped rubber (10) aims at the same advantage as the above-cited Japanese Utility Model Application Laid-Open No. 3-68285 in which the tight materials are disposed in contact with the opposite sides of the projecting portion. This fact leads to the technical problem that sliding manipulability is inferior and rainwater stored in the bottom guide enters an indoor side owing to a capillary phenomenon and the pressure difference between outside air and the indoor side.

In addition, since a drain passage is only disclosed as a mere idea, it is impossible to obtain strength enough to support the weight of a door and the weight of a person who goes in and out.

BRIEF SUMMARY OF THE INVENTION

To cope with the aforementioned pulsating pressure requirements of the Japanese Industrial Standards, close examinations were made as to a sealing structure which is stable between a sliding sash and a window frame, and as to a structure which can reliably drain rainwater flowing onto the flat surface of a sill in a large amount and can ensure strength and rigidity enough to endure weights such as the weight of a door which slides to open and close and the weight of a person who goes in and out. The following structure was found out as the result of such examinations.

The present invention may provide an outdoor window with a flat sill, which is disposed in a doorway of a building opening which separates an indoor side and an outdoor side. The outdoor window is of a barrier free type in which the top surface of a window sill is made approximately flat in such a way that projecting rails are eliminated from the top surface of the window sill and steps which would have been disposed in the direction in which a person goes in and out are eliminated. The outdoor window is superior in the drainage of rainwater or the like accompanied by wind pressure and is high in watertightness against indoor water leakage. More particularly, the invention aims to provide a structure which is effective in improving the drainage of rainwater or the like while ensuring the strength and rigidity of the sill in the case where a linear drain groove is provided on the above-described flat surface.

In accordance with one embodiment of the present invention, as a member for providing a stable sealing function between a sliding sash and a window frame against a pulsating wind pressure, a tight material made of an elastic material is interposed between an indoor side of the sliding sash and the window frame as a sealing structure which applies a stronger pressure as the sliding sash receives a stronger wind pressure from an outdoor side.

Then, as a structure which stably drains rainwater from the flat surface and is of high strength, a linear groove of narrow width is provided to extend on the flat surface in a sash sliding direction, and a water collecting groove which is wider than this groove is provided immediately below the groove as a cavity for receiving rainwater. Immediately below the water collecting groove, a guiding hollow portion which guides rainwater outdoors is provided, and is made to communicate with a drain portion provided at the bottom of the water collecting groove.

Furthermore, an outdoor drain port is provided at an outdoor side of the guiding hollow portion, thereby forming a double structure which is made of the sill water collecting groove and the guiding hollow portion and allows the above-described sill water collecting groove and the guiding hollow portion to communicate with outside air.

The horizontal tight materials are respectively provided as sealing member between the slide portions extended vertically downwardly from indoor side walls of bottom rails of the sliding sash and indoor side walls of the sill grooves, but no such horizontal tight materials are provided between outdoor (exterior) sides of the slide portions and side walls of the sill grooves, and the slide grooves aiming at drainage are present. Accordingly, owing to these gaps, the sliding sashes can be smoothly moved, and when a wind pressure is applied to the window surfaces from the outdoor side, the indoor side walls of the slide portions and the horizontal tight material are strongly pressed by the wind pressure, whereby sealing performance is improved. In addition, gaps between the slide portions and the outdoor side walls of the slide grooves become large in proportion to the wind pressure, and rainwater flows from the slide grooves into the sill groove portions together with outside air.

In accordance with another embodiment of the invention, there is provided an outdoor window which has a window frame which includes a head, a sill, and side jambs and is disposed in a doorway of a building opening which separates an indoor side and an outdoor side, and a sliding sash which opens and closes by sliding on an interior side of the window frame, so that a drain structure of the sill is formed by a semi-equal pressure water balance structure, while airtightness and watertightness are ensured in such a way that a sealing portion provided between a sliding sash and a window frame is pressed by wind pressure. In the outdoor window, sealing member is provided between the sliding sash and the sill so that the sealing portion is pressed when a wind pressure is applied to the sliding sash from the outdoor side, and a drain groove is provided on a top surface of the sill so that rainwater falling on the sealing member is drained, and a water collecting groove having a width wider than a width of the drain groove is provided immediately below the drain groove.

A drain port is provided at a bottom of the water collecting groove for the purpose of draining the water from the collecting groove, and a guiding hollow portion which guides rainwater outdoors is provided immediately below the drain port and an outdoor drain port is provided in an outdoor side of the guiding hollow portion. The water collecting groove and thus guiding hollow portion communicate with outside air.

If the semi-equal pressure water balance structure is applied to a double-sliding window, there is provided an outdoor window according to another embodiment of the invention comprising: a window frame which includes a head, a sill having a flat top surface and side jambs and is disposed in a doorway of a building opening which separates an indoor side and an outdoor side; inner and outer sliding sashes each of which has side stiles and slides to open and close on an interior side of the window frame; a drain groove provided on the flat top surface of the sill; a water collecting groove having a width wider than the width of the drain groove and provided immediately below the drain groove; a first sealing member provided between a vertically downwardly extended portion provided on an indoor side wall of a bottom rail of each of the sliding sashes and a side wall of the water collecting groove of the sill; a second sealing member between the side stiles of each of the sliding sashes and the side jambs of the window frame; a third sealing member which separates the indoor side and the outdoor side and is provided between a sliding sash mating portion and the flat top surface of the sill; a water stopping block provided in the water collecting groove at the position below an inner sliding sash mating portion; a predetermined gap provided between a wall of the drain groove and an outdoor side of the vertically downwardly extended portion; a drain port provided at a bottom of the water collecting groove; a guiding hollow portion which guides rainwater outdoors and is provided immediately below the drain port; and an outdoor drain port provided in the outdoor side of the guiding hollow portion. The sealing portions of the first and second sealing member are pressed when a wind pressure is applied to the sliding sashes from the outdoor side, and the water collecting groove and the guiding hollow portion communicate with outside air.

It is to be noted that in the case of the double-sliding window, it is necessary to provide the sealing member between the mating portion and the sill top surface, and since a single sealing member has the risk of allowing rainwater to enter due to a capillary phenomenon, it is desirable to secure at least a double sealing member.

In addition, in the case where the drain groove of the sill and a slide groove for an inner sliding sash are formed as the same groove, the water stopping block is desirably disposed to the sill water collecting groove in the mating portion in order to prevent rainwater from entering the indoor side along the sill water collecting groove for the inner sliding sash.

In the case where the semi-equal pressure water balance structure is applied to a single-sliding window, a sliding sash is slidably placed between a head and a sill. In an outdoor single sliding sash having a building opening and a sliding sash accommodating portion, a sealing member is provided between a vertically downwardly extended portion provided on a bottom rail of the sliding sash and the sill so that a sealing portion is pressed when a wind pressure is applied to the sliding sash from the outdoor side, and the sealing member is provided between a vertical bone disposed vertically between the head and thus sill and a sliding sash mating stile as well as between a sliding sash stopper stile and a jamb. A drain groove is provided on a flat top surface of the sill, a water collecting groove having a width wider than a width of the drain groove is provided immediately below the drain groove, a drain port is provided at a bottom of the water collecting groove, a guiding hollow portion which guides rainwater outdoors is provided immediately below the drain port, and an outdoor drain port is provided in an outdoor side of the guiding hollow portion. The water collecting groove and the guiding hollow portion communicate with outside air.

In a window frame in which the structure of a sill is divided into a sill base member and a top surface member to facilitate formation of a water collecting groove and a drain groove and also to facilitate working of a drain port, the window frame including four side frame portions and disposed in a doorway of a building opening which separates an indoor side and an outdoor side, the sill is made of the sill base member of hollow sectional shape having the drain port at its top and an outdoor drain port at its bottom, and the top surface member having an approximately flat top surface.

The sill base member is provided with a fitting portion into which to fit the top surface member, at the top of the sill base member, and the top surface member is provided with a disposed portion capable of being disposed into the fitting portion of the sill base member. The top surface member is disposed into the sill base member and forms a sill drain groove together with the sill base member, and a bottom of the drain groove forms a water collecting groove wider than the drain groove, and the sill drain groove and the outdoor drain port communicate with outside air via the water collecting groove, the drain port and the guiding hollow portion.

In the invention, projecting rails are eliminated from the sill top surface, and the top surface of the sill is formed to be approximately flat, and a thin linear drain groove is provided on the top surface of the sill and the water collecting groove of large width is provided immediately below this drain groove, and the water collecting groove and the guiding hollow portion which communicate with outside air via the water collecting groove, the guiding hollow portion and the outdoor drain port constitute a double structure. Accordingly, the double structure ensures the strength and the rigidity of the sill, and can achieve superior drainage by functioning so that pressures occur on the outdoor side and in the interior of the sill and rainwater falling under wind pressure is made to flow into the above-described water collecting groove. In addition, even if a certain amount of rainwater stays in the water collecting groove, rainwater does not fall on the sealing portion and can be prevented from entering the indoor side owing to a capillary phenomenon.

In addition, there is provided a sealing member which separates an outdoor (exterior) side and an indoor (interior) side, according to the opening/closing mechanism of a window such as a double-sliding window or a single-sliding window, and since the drain groove and the drain port are provided to correspond to this sealing portion, the flow of outside air and rainwater can be stopped at the sealing portion, and rainwater can be made to flow downwardly. Accordingly, it is possible to achieve superior airtightness and watertightness while ensuring the strength and the rigidity of the sill.

BRIEF DESCRIPTION OF THE DRAWINGS

FIG. 1 (Table 1) shows evaluation results based on the pressure difference between wind pressures.

DETAILED DESCRIPTION OF THE INVENTION

The functions of a window in accordance with one embodiment of the invention with respect to airtightness, watertightness and drainage will be described below in detail on the basis of schematic views of the window and the result of experimentation.

Figure 5:
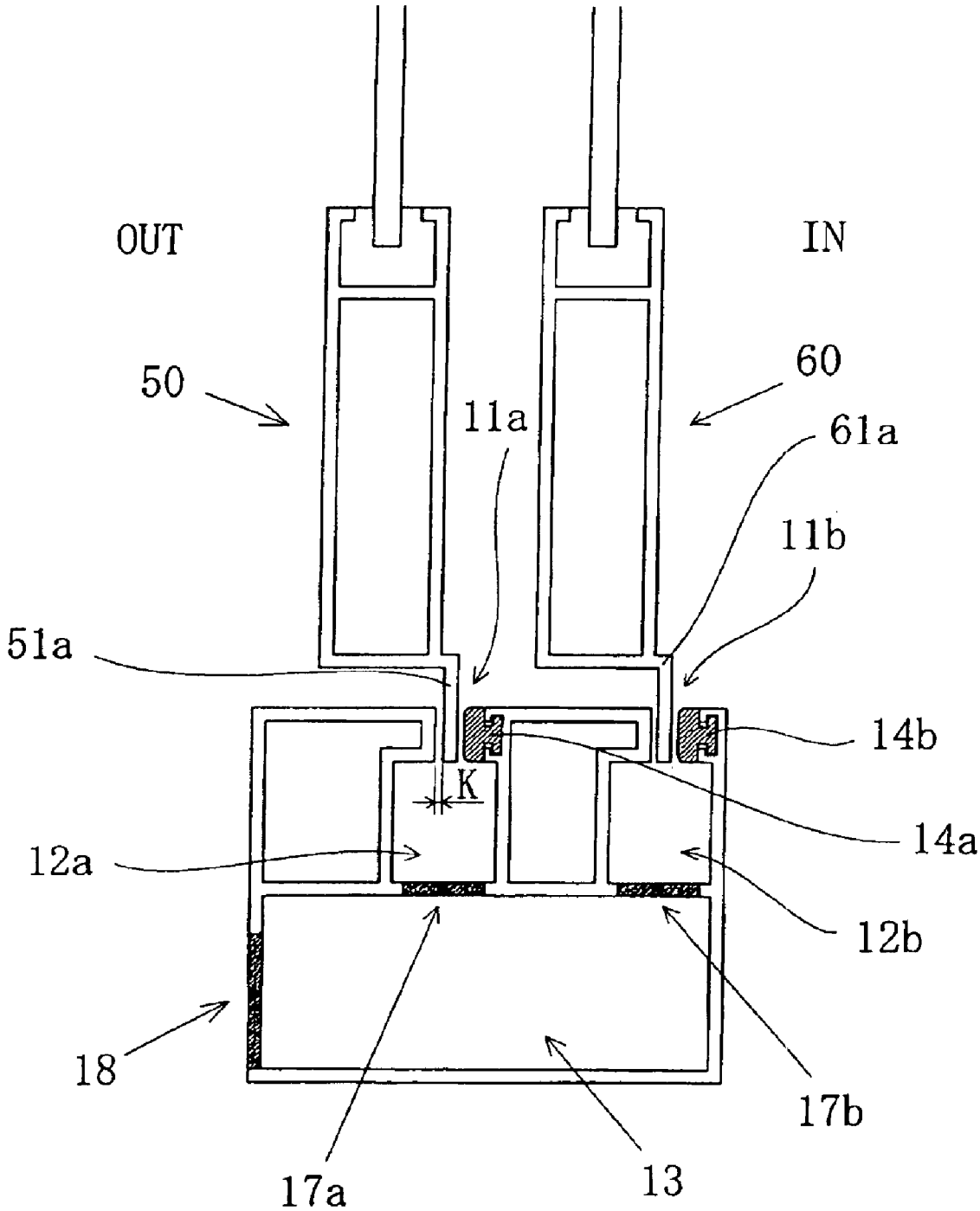
FIG. 5 shows a schematic view showing the state in which wind pressure is not applied to a sliding sash.

The schematic view shown in FIG. 5 shows the state in which neither wind nor rain is loaded onto sliding sashes.

In the shown structure, drain grooves 11*a* and 11*b* are provided in a sill whose top surface is formed as a flat surface, and vertically downwardly extended portions 51*a* and 61*a* which are respectively provided on the bottom rails of an outer sliding sash 50 and an inner sliding sash 60 are inserted in the respective drain grooves 11*a* and 11*b* and are slidable in the opening/closing directions of the sliding sashes. Tight materials 14*a* and 14*b* are disposed on the indoor sides of the respective vertically downwardly extended portions.

Accordingly, the vertically downwardly extended portions provided on the respective bottom rails form sealing portions, and also serve the functions of slide portions when the respective sliding sashes are opened or closed. The drain grooves provided in the top surface of the sill also function as slide grooves in which the respective vertically downwardly extended portions (slide portions) provided on the bottom rails slide.

Water collecting grooves 12*a* and 12*b* which are respectively wider than the widths of the drain grooves are provided immediately below the respective drain grooves, and drain ports 17*a* and 17*b* are provided at the bottoms of the respective water collecting grooves, and a guiding hollow portion 13 which guides rainwater flowing in from the drain ports to an outdoor drain port 18 for draining rainwater outdoors is provided.

Figure 6:
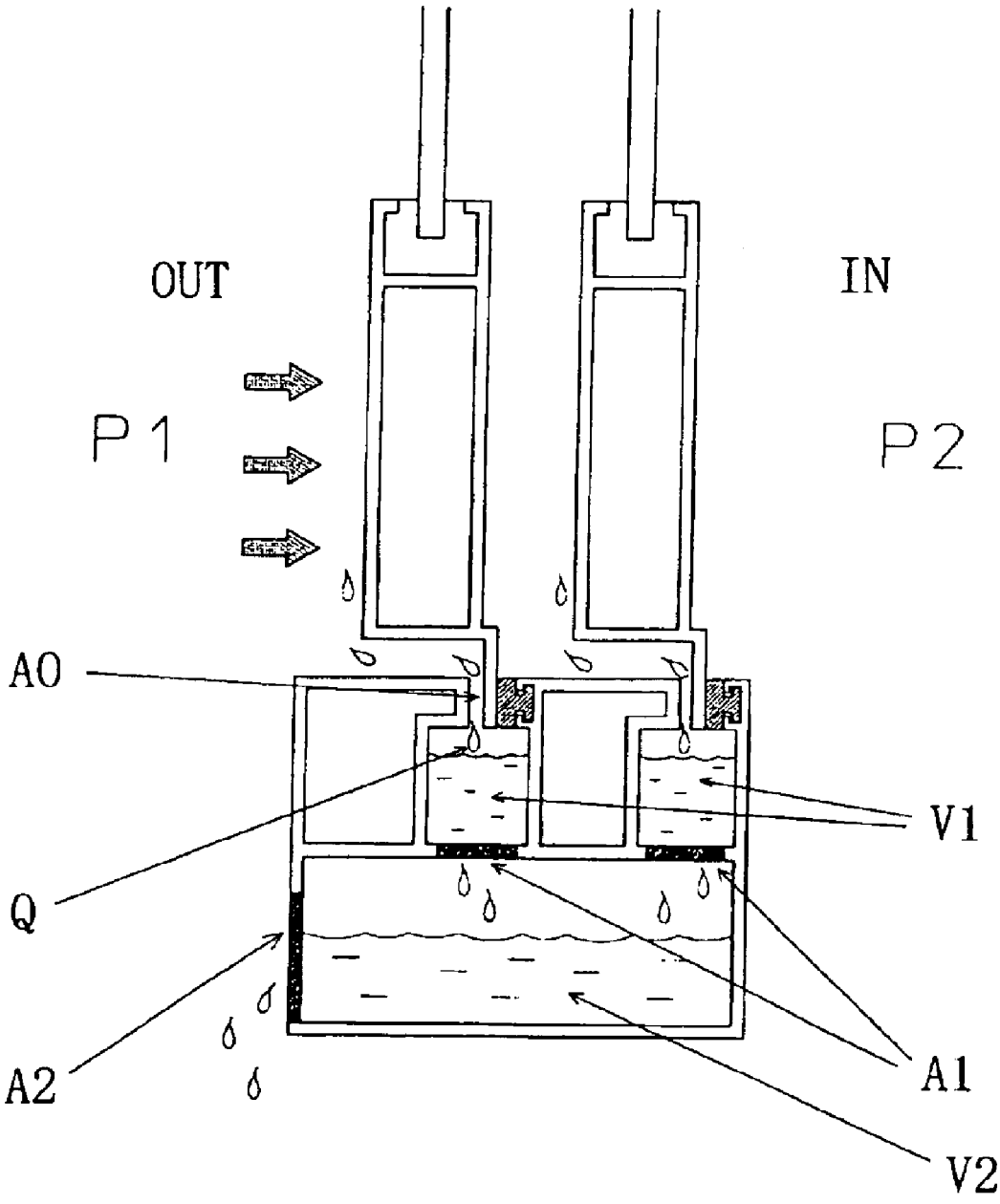
FIG. 6 shows a schematic view showing the state in which wind pressure is applied to the sliding sash.

FIG. 6 shows a schematic view of the state of being exposed to wind and rain.

When a wind pressure P1 is applied from outdoors, the sliding sashes are pressed and the vertically downwardly extended portions (slide portions) provided on the bottom rails and the tight materials are brought into pressure contact with each other, whereby sealing performance such as airtightness and watertightness is ensured.

Rainwater which falls on the outdoor surfaces or the like of the windows under wind pressure flows from the flat surface of the sill into the water collecting grooves inside the sill through the drain grooves, and further flow into the drain ports and the guiding hollow portion, and is drained outdoors through the outdoor drain port.

Since the water collecting grooves are provided immediately below sealing lines which are formed when the vertically downwardly extended portions provided on the bottom rails and the tight materials are brought into pressure contact with each other, rainwater does not stay in the sealing portions and can be prevented from entering the indoor side owing to a capillary phenomenon.

The horizontal tight materials are respectively provided as sealing member between the slide portions extended vertically downwardly from indoor side walls of bottom rails of the sliding sash and indoor side walls of the sill grooves, but no such horizontal tight materials are provided between outdoor (exterior) sides of the slide portions and side walls of the sill grooves, and the slide grooves aiming at drainage are present. Accordingly, owing to these gaps, the sliding sashes can be smoothly moved, and when a wind pressure is applied to the window surfaces from the outdoor side, the indoor side walls of the slide portions and the horizontal tight material are strongly pressed by the wind pressure, whereby sealing performance is improved. In addition, gaps (refer to FIG. 5) between the slide portions and the outdoor side walls of the slide grooves become large in proportion to the wind pressure, and rainwater flows from the slide grooves into the sill groove portions together with outside air.

In the invention, in the case where the slide portions are respectively provided on the indoor side walls of the bottom rails, the following function is obtained.

First of all, by way of comparison, the case where the slide portions are respectively provided on the outdoor side walls of the bottom rails will be described below with reference to FIG. 7. Glass-passing packing 201 is provided between each sliding sash member such as a sliding sash bottom rail and a glass 200, to seal the gap therebetween. However, when a large wind pressure is applied to a door surface, the glass is strongly pressed toward an indoor side and there is a high risk that the sealing of a packing material portion becomes weak on an outdoor side and rainwater enters from this portion.

Each bottom rail has a glass-clearance drain port 203, a bottom-rail lower drain port 204 and a cutout portion such as a roller mounting portion. In the case where a slide portion is disposed on the outdoor side wall of the bottom rail, the interior of the bottom rail communicates with the indoor side, as shown in FIG. 7, and the pressure difference between a glass clearance and the indoor side becomes large under wind pressure, so that a large amount of rainwater enters owing to this pressure difference.

Figure 8:
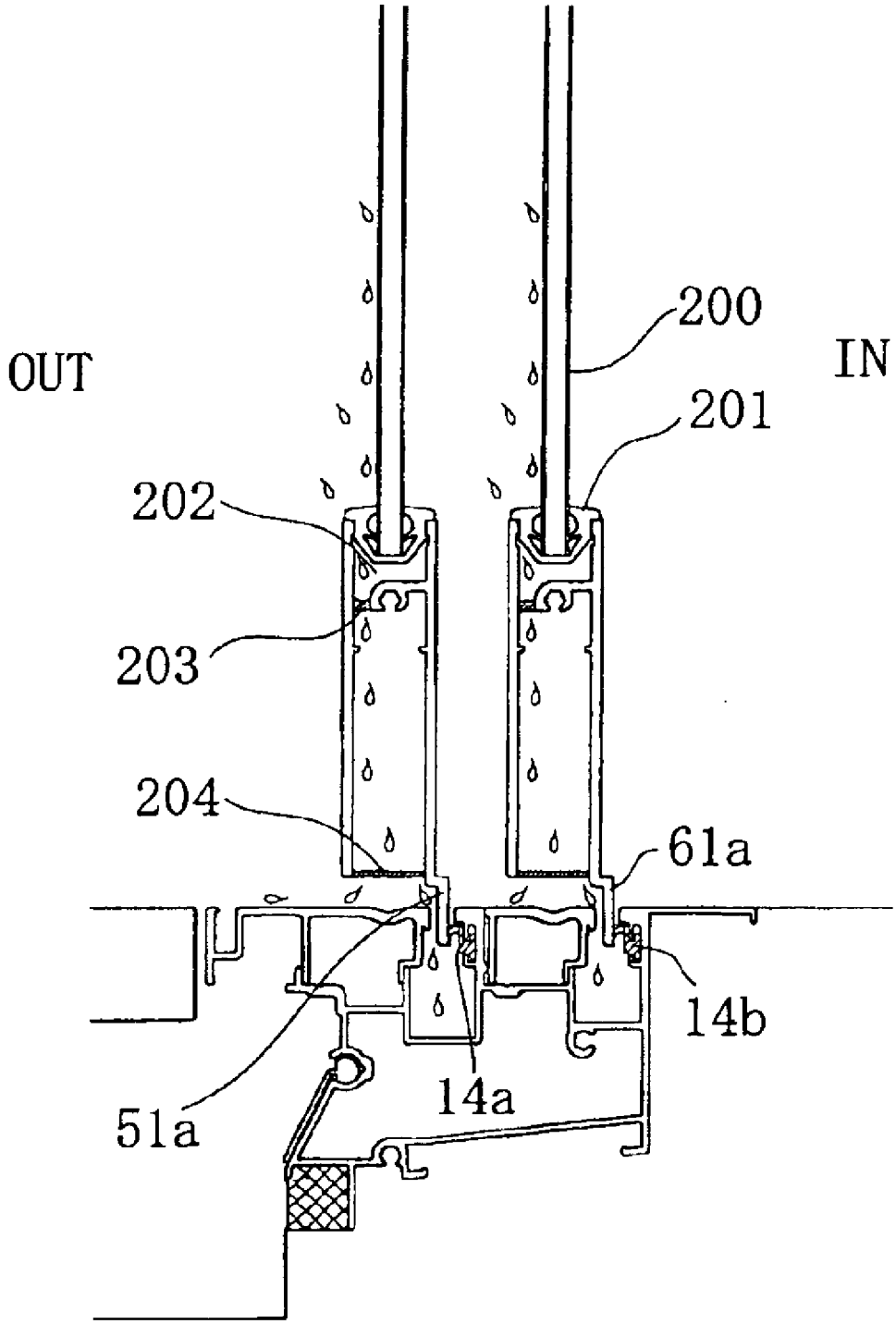
FIG. 8 shows the flow of rainwater when a sliding sash slide portion is disposed on an indoor side.

On the other hand, in the case where the slide portion is provided on the indoor side wall, the interior of the bottom rail communicates with outside air, as shown in FIG. 8, and the pressure of a glass clearance 202 approximates that of outside air and functions to restrain a large amount of rainwater from flowing onto a sill flat surface from the above-described glass-clearance drain port or the bottom-rail lower drain port.

Figure 7:
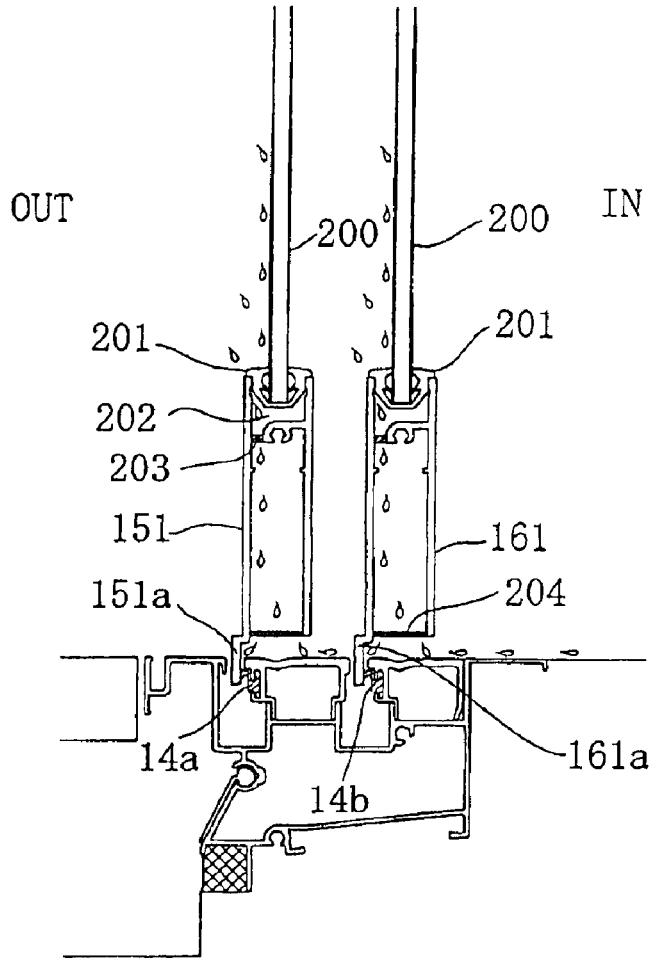
PRIOR ART FIG. 7
FIG. 7 shows the flow of rainwater when a sliding sash slide portion is disposed on an outdoor side.

In each of FIGS. 7 and 8, the cross sections of an outer sliding sash and an inner sliding sash are shown to be juxtaposed for the sake of convenience. However, when actual outside and inner sliding sashes are in a closed state, if rainwater which enters the insides of their bottom rails from glass sealing surfaces, rainwater will flow directly into the indoor side in the case where the slide portions are provided at the outdoor side. In the case where the respective slide portions are provided on the indoor side walls, not only do the pressures of the glass clearances approximate that of outside air, but the slide portions provided on the indoor side walls function to prevent rainwater from entering indoors.

Figure 2:
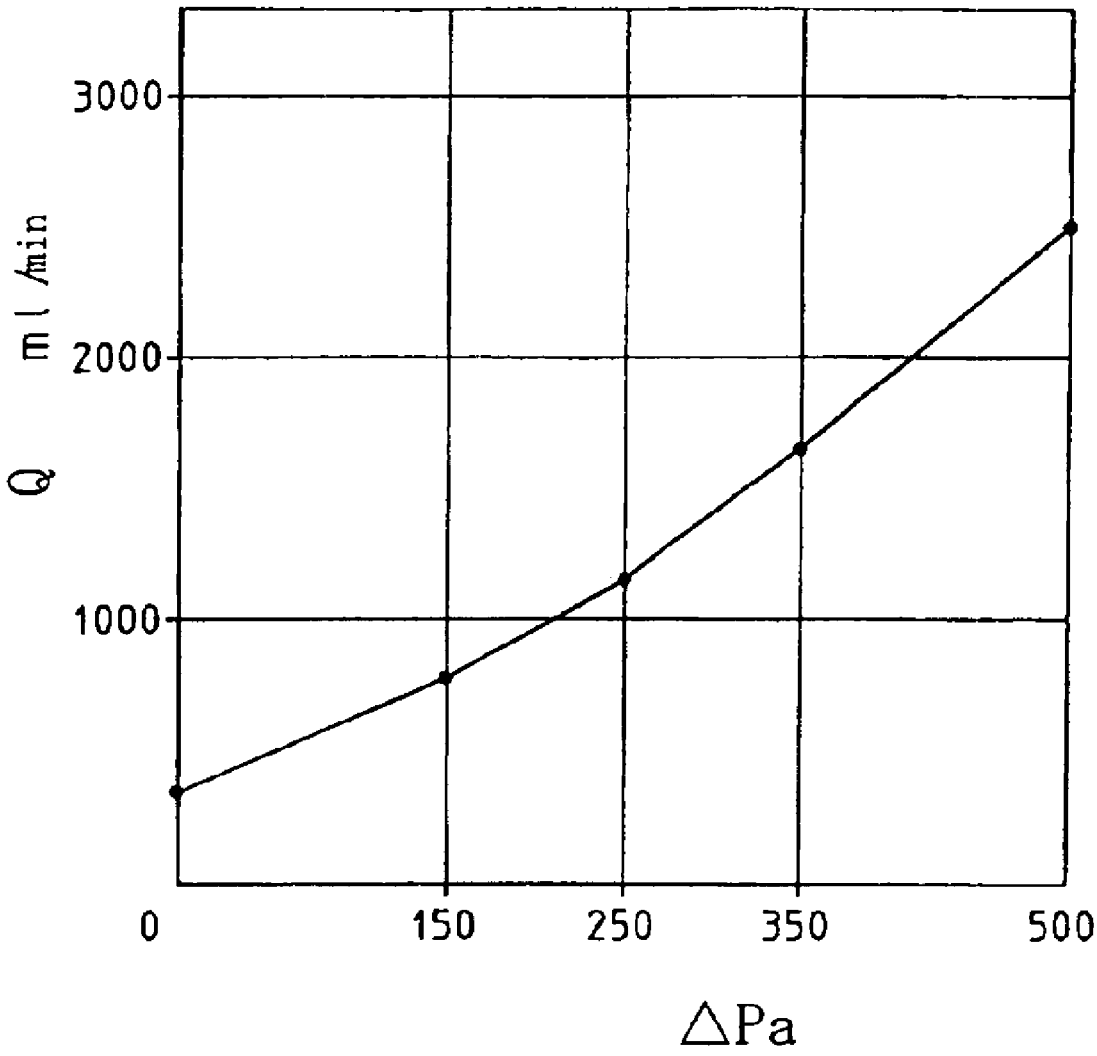
FIG. 2 (Graph 1) shows the relationship between the pressure difference and a water quantity (Q) which enters the inside of a sill.
Figure 3:
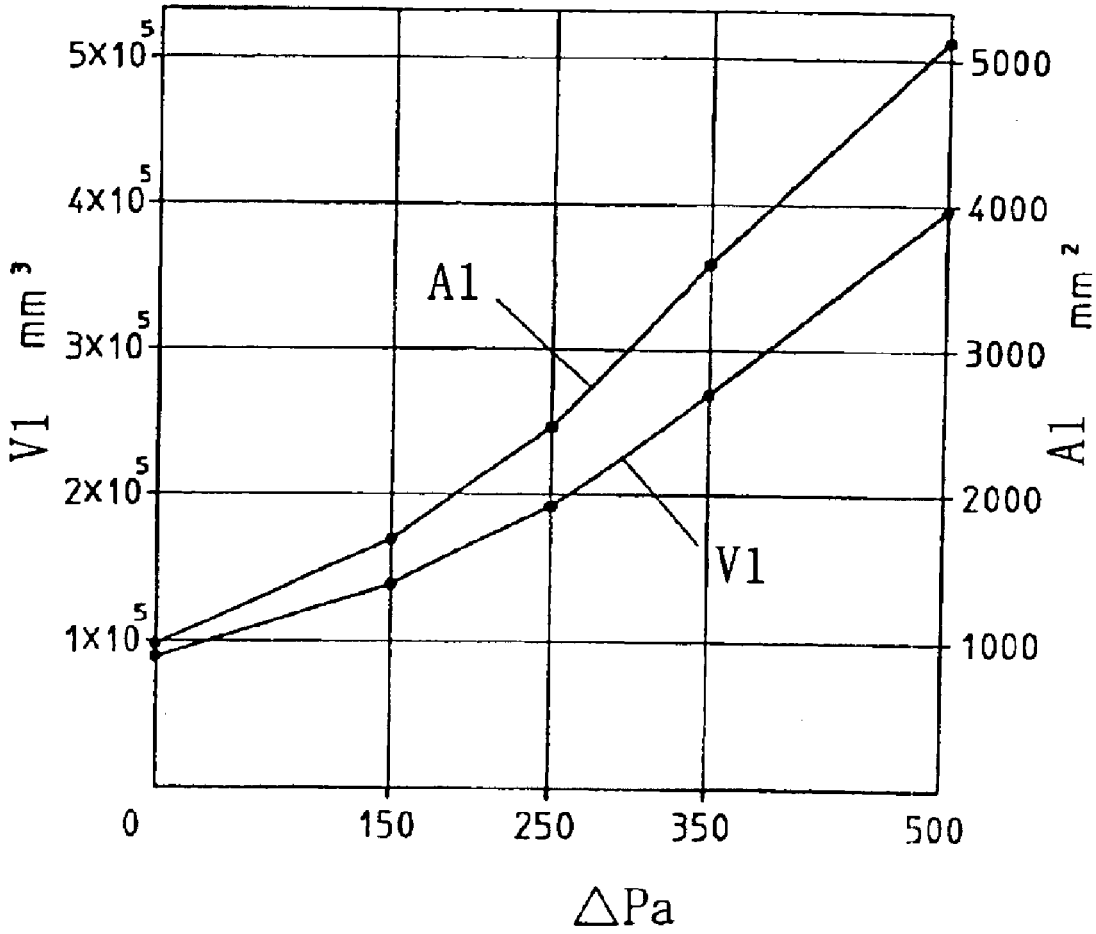
FIG. 3 (Graph 2) shows the relationship between the pressure difference and a necessary volume (V1) of a water collecting groove, and the relationship between the pressure difference and a necessary area (A1) of a drain port.
Figure 4:
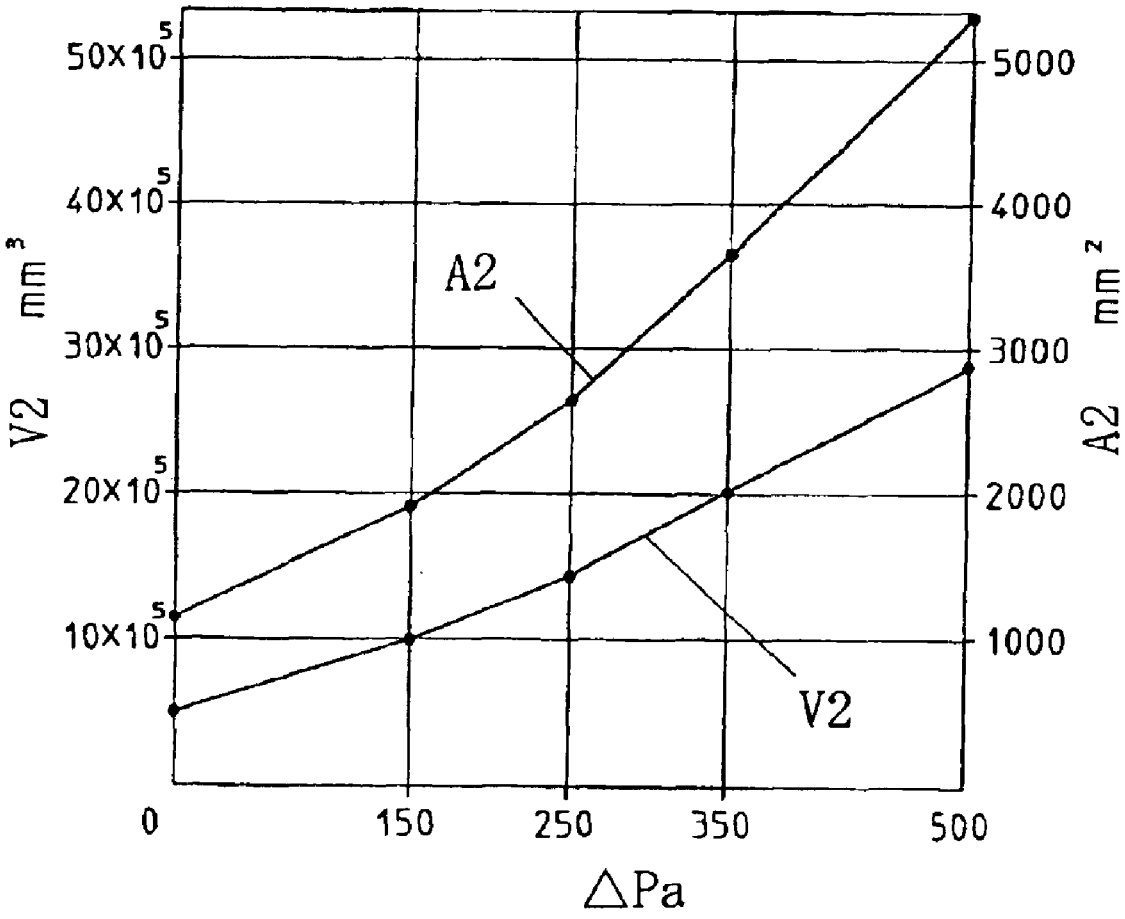
FIG. 4 (Graph 3) shows the relationship between the pressure difference and a necessary volume (V2) of a guiding hollow portion, and the relationship between the pressure difference and a necessary area (A2) of an outdoor drain port.

FIG. 1 (Table 1) shows the results that have been obtained by conducting experiments in order to clarify, in the case where such a structure is adopted as shown in FIG. 6, a necessary volume (V1) of a water collecting groove (X1), a necessary area (A1) of a drain port, a necessary volume (V2) of a guiding hollow portion (X2) and a necessary area (A2) of an outdoor drain port, all of which are required to clear the above-mentioned quality standard specified under Japanese Industrial Standards as to variations in wind pressure. FIG. 2 (Graph 1) shows the relationship between the pressure difference between wind pressures and a water quantity (Q) which enters the inside of a sill. FIG. 3 (Graph 2) shows the relationship between the pressure difference and the necessary volume (V1) of the water collecting groove, and the relationship between the pressure difference and the necessary area (A1) of the drain port. FIG. 4 (Graph 3) shows the relationship between the pressure difference and the necessary volume (V2) of the guiding hollow portion, and the relationship between the pressure difference and the necessary area (A2) of the outdoor drain port.

Incidentally, the entire length of a sill subjected to the test is 1,800 mm.

From the result of Graph 1, it is apparent that as wind pressure increases under the condition that the area of the inside of a sill which rainwater enters from a drain groove and the like is constant, the water quantity which enters the inside of the sill increases and a strong positive correlation appears. Accordingly, it is apparent that the necessary volumes (V1), (V2) and the necessary areas (A1), (A2) for clearing the quality standard of Japanese Industrial Standards need to be increased as obtained from the experiments.

Resulting from Table 1, it is apparent that when the values in a row of 500 Pa are compared from left to right, the relationship: A0(5050)<A1(5130)<A2(5300) is necessary.

Principles which have yielded these results will be described on the basis of the schematic views shown in FIGS. 5 and 6. When there is neither wind nor rain, the drain grooves provided in the top surface of the sill, the water collecting grooves, the drain ports, the guiding hollow portion and the outdoor drain port communicate with one another and outside air enters from the drain grooves and the outdoor drain port, whereby the pressure of each of the water collecting grooves and the guiding hollow portion is equal to the pressure of outside air.

However, when a wind pressure is applied, the gaps K become large, but the width of each of the drain grooves is as narrow as approximately 4 mm and water film is formed in the drain grooves by rainwater, so that outside air is not completely introduced into the water collecting grooves, and a small pressure difference occurs between the outdoor side and the water collecting grooves. Accordingly, rainwater is absorbed into the water collecting grooves.

As a result, as the pressure of the outdoor side increases, the pressure difference between the outdoor side and the water collecting grooves increases, and the water quantity which enters the water collecting grooves increases.

In the meantime, rainwater is drained from the water collecting grooves into the guiding hollow portion through the drain ports, and the introduction of air into the water collecting grooves through the guiding hollow portion is also effected through the same drain ports through which rainwater flows. Therefore, the pressure of each of the water collecting grooves and the pressure of the guiding hollow portion do not become completely equal, and this face becomes the cause of yielding a pressure difference.

Therefore, in the invention, the term "semi-equal pressure" means that when there is neither wind nor rain, the pressure of the inside of the sill is equal to the pressure of outside air, and when rainwater accompanied by wind pressure occurs, as the wind pressure increases, the pressure of the inside of the sill decreases compared to the outside pressure.

In the invention, the fact that the flow of rainwater is maintained in the above-described state is hereinafter referred to as water balance. As the outdoor pressure increases, the water quantity that enters the water collecting grooves and the guiding hollow portion increases. Therefore, the volume of each of the water collecting grooves and the guiding hollow portion is made large and each of the drain ports is set to an appropriate size, whereby rainwater which enters the interior of the sill is prevented from staying in the sill. Namely, the term "semi-equal pressure" means the art of maintaining the balance between an entering water quantity and a water quantity to be drained.

Embodiments of the present invention applied to a double sliding window will be described below.

Figure 18:
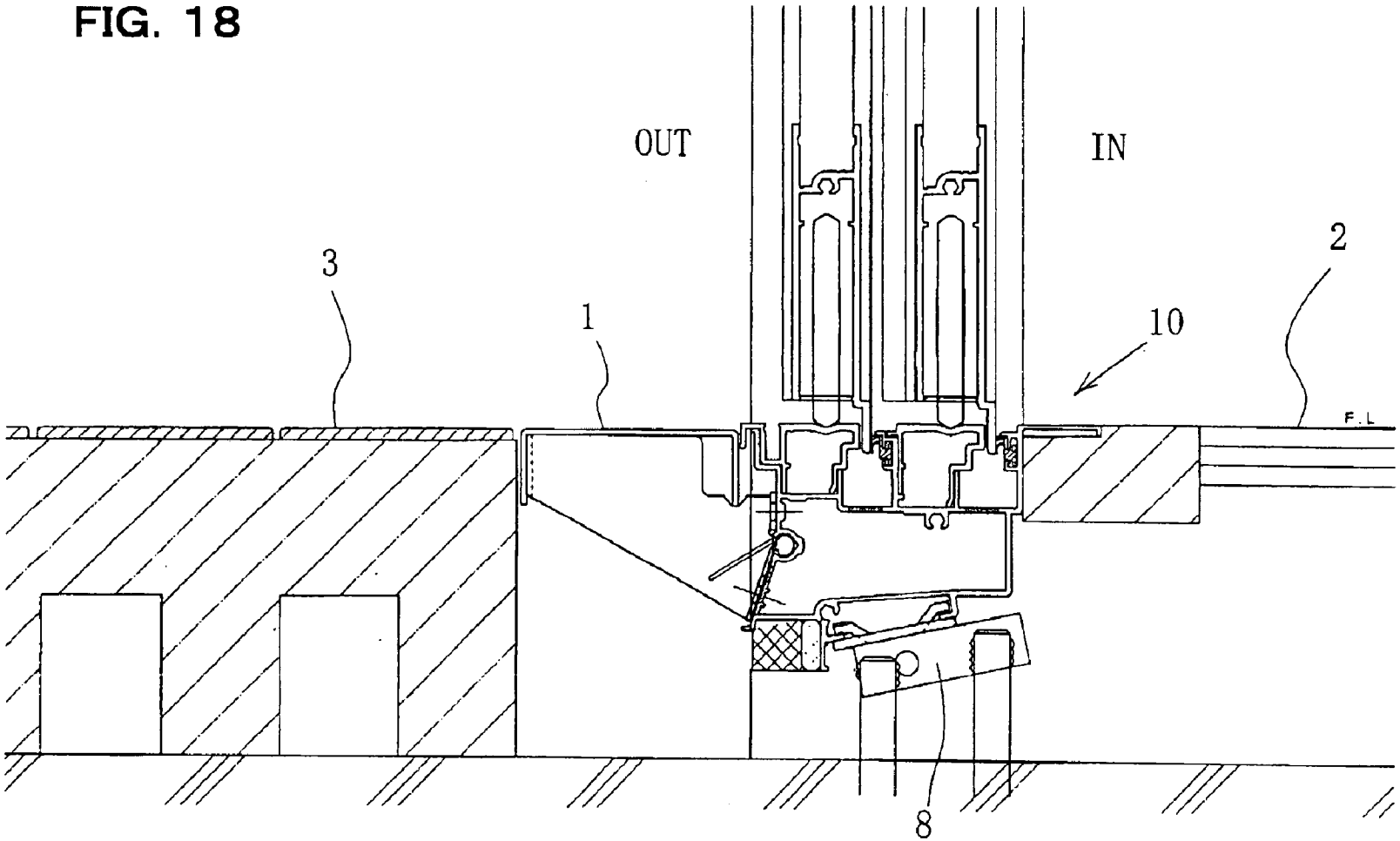
FIG. 18 shows a cross-sectional view of a building opening.
Figure 19:
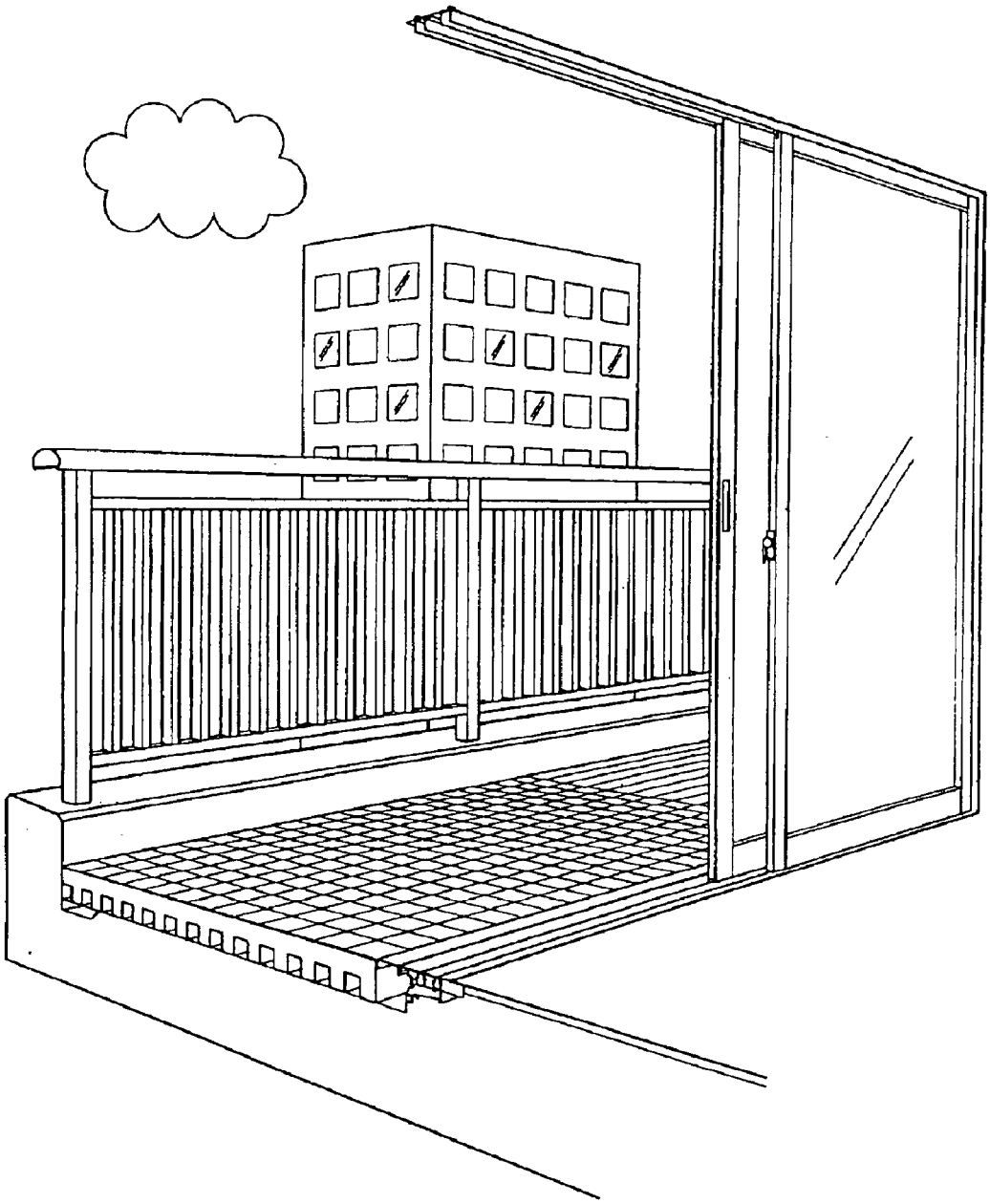
FIG. 19 shows an image showing an outdoor barrier free window according to the invention.
Figure 20:
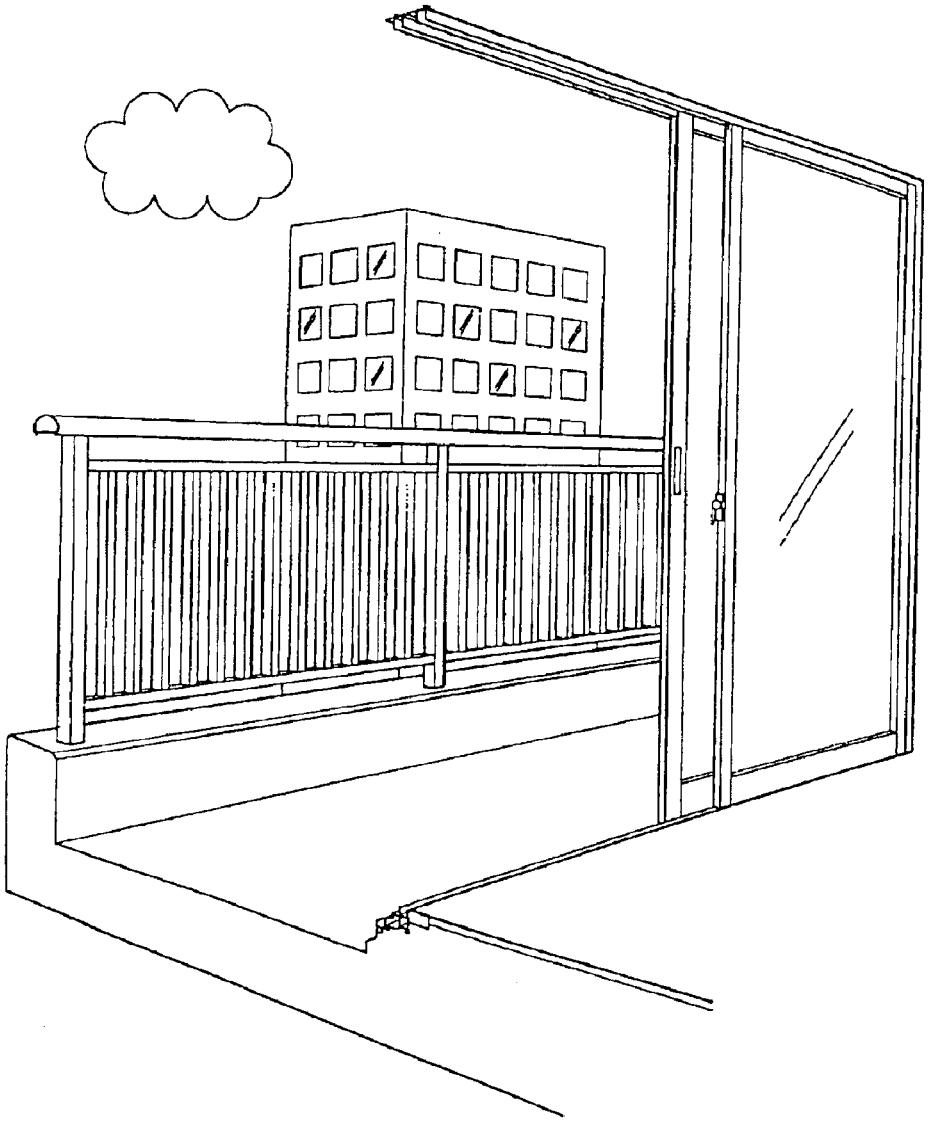
PRIOR ART FIG. 20
FIG. 20 shows an image showing an existing window having steps.

FIG. 19 shows an image of an outdoor barrier free window according to the invention, and FIG. 18 shows a cross section of its outdoor opening.

A drain grating 1 is installed on an outdoor side of a door of a building house, and at the outside of the drain grating 1, step adjusting blocks 3 are laid out, and although not shown, a balcony is disposed, and a safety fence such as a balustrade is disposed further outward.

A window according to the invention is adopted at a doorway between a room and the balcony.

Figure 9:
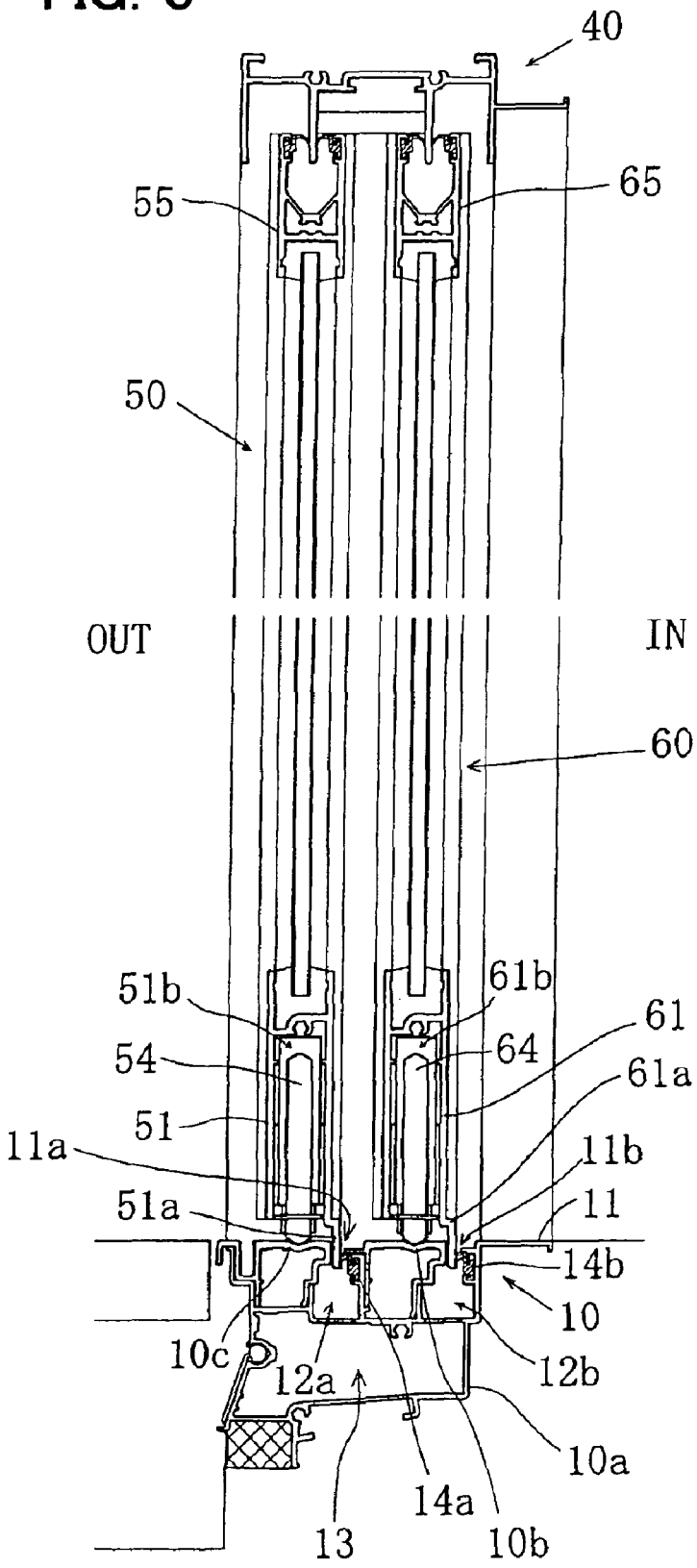
FIG. 9 shows a cross sectional view showing a double-sliding window to which the invention is applied.
Figure 10:
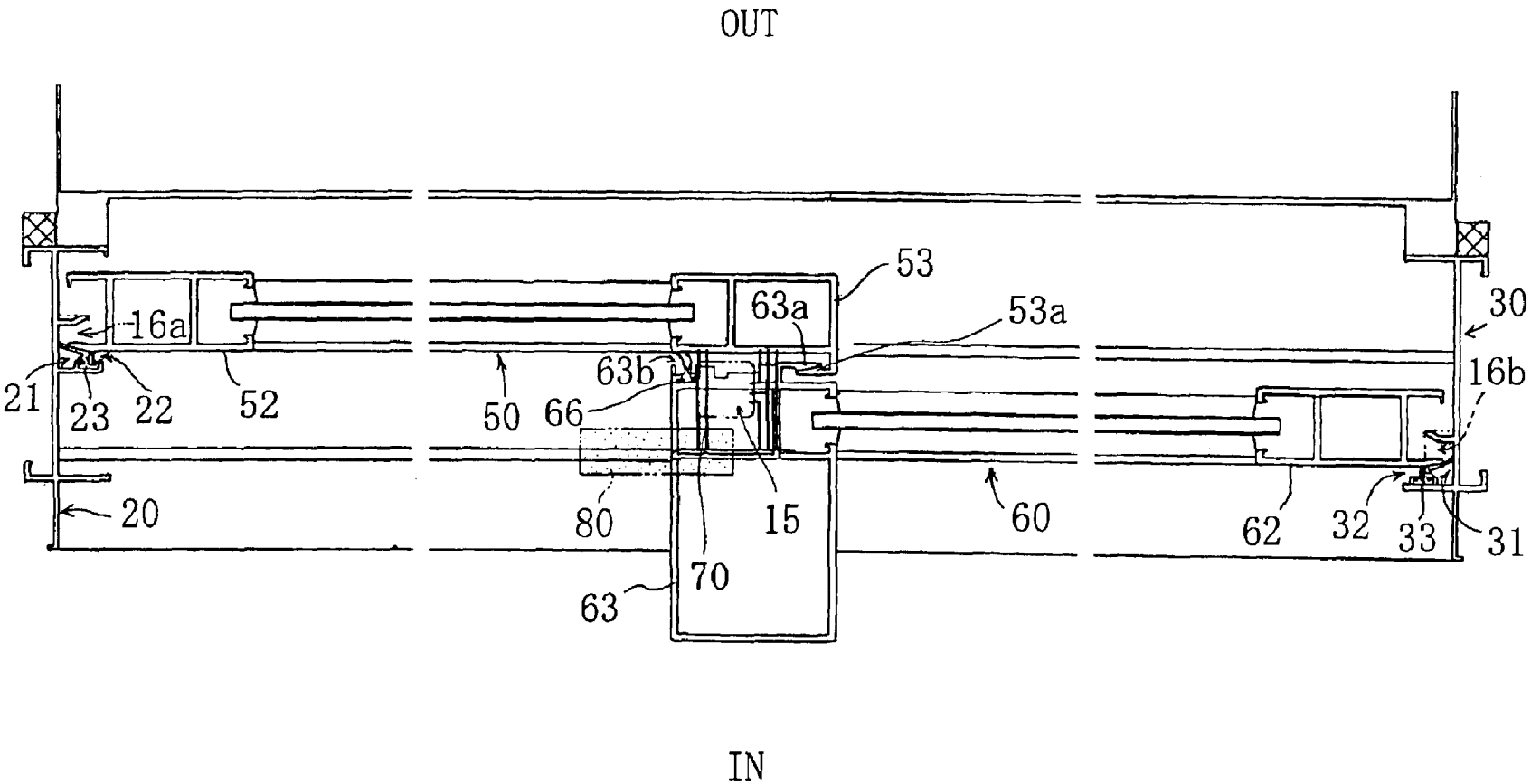
FIG. 10 shows a horizontal sectional view showing the double-sliding window to which the invention is applied.

FIG. 9 shows a cross sectional view of a window sill according to the invention, and FIG. 10 shows a horizontal sectional view of the same. The frame is formed of a sill 10 and a head 40 fixed to a building by anchors 8 as shown in FIGS. 9 and 18, and a left jamb 20 and a right jamb 30 as shown in FIG. 10. An outer sliding sash 50 and an inner sliding sash 60 are installed in the frame in this order from the outdoor side.

As shown in FIG. 18, the sill does not have projecting rails such as those which would have heretofore been required, and the top surface of the sill is formed as a flat surface in such a manner that two grooves each of which is approximately equivalent to the wall thickness of a sash slide portion of a bottom rail of one of the sliding sashes are formed on the top surface of the sill, whereby steps can be omitted from the boundaries between verandas and indoor sides of apartment buildings and the like. Accordingly, a barrier free structure is formed in which a floor surface 3 of the balcony is disposed to be approximately flush with a floor surface 2 of indoor flooring, the top surface of the sill 10 and the grating 1.

As shown in FIGS. 9 and 10, the outer sliding sash 50 has a frame formed by an outer sliding sash bottom rail 51 and an outer sliding sash top rail 55 as well as an outer sliding sash stopper stile 52 and an outer sliding sash mating stile 53, and a glass plate or the like is disposed in the inside of the outer sliding sash 50.

An outer sliding sash slide portion 51*a* is extended vertically downwardly at the indoor side of the outer sliding sash bottom rail 51. Outer sliding sash wheels 54 are disposed in a bottom-rail groove portion 51*b* of the bottom rail in such a manner as to travel on an approximately flat top surface 11 of the sill 10.

Similarly to the outer sliding sash, the inner sliding sash 60 has a frame formed by an inner sliding sash bottom rail 61 and an inner sliding sash top rail 65 as well as an inner sliding sash stopper stile 62 and an inner sliding sash mating stile 63, and a glass or the like is disposed in the inside of the inner sliding sash 60.

An inner sliding sash slide portion 61*a* is extended vertically downwardly at the indoor side of the outer sliding sash bottom rail 61. Inner sliding sash wheels 64 are disposed in a bottom-rail groove portion 61*b* of the bottom rail in such a manner as to travel on the approximately flat top surface 11 of the sill 10.

The sill 10 is provided with a sill water collecting groove 12*a* for the outer sliding sash and a sill water collecting groove 12*b* for the indoor sliding sash both of which respectively have an outer sliding sash slide groove 11*a* and an inner sliding sash slide groove 11*b*, and the outer sliding sash slide portion 51*a* and the inner sliding sash slide portion 61*a* which are respectively extended vertically downwardly at the bottom rails of the outer sliding sash and the inner sliding sash are slidably disposed in the outer sliding sash slide groove 11*a* and the inner sliding sash slide groove 11*b*, respectively. An outer sliding sash horizontal tight material fitting groove and an inner sliding sash horizontal tight material fitting groove are provided on the indoor-side wall surfaces of the respective groove portions 12*a* and 12*b*, and an outer sliding sash horizontal tight material 14*a* and an inner sliding sash horizontal tight material 14*b* are respectively disposed in the respective fitting grooves. These horizontal tight materials are in sliding contact with the respective slide portions of the sliding sashes.

The sill 10 has a construction in which a base member 10*a* having a guiding hollow portion 13 formed by extrusion using aluminum alloy or the like, and top surface members 10*b* and 10*c* are combined together by fitting.

Accordingly, it is possible to easily perform various kinds of work such as the work of cutting the flat surface of the sill, the work of forming a drain port of the sill water collecting grooves and the work of securing water stopping blocks for the sill water collecting grooves.

As shown in FIG. 10, a left jamb recess portion 21 for receiving the stopper stile of the outer sliding sash is provided on the inside of the left jamb 20, and a left-jamb vertical tight material fitting groove 22 is provided on an indoor side wall of this left jamb recess portion 21 and a left-jamb vertical tight material 23 is disposed in the left-jamb vertical tight material fitting groove 22.

Similarly to the case of the outer sliding sash, a right jamb recess portion 31 for receiving the stopper stile of the inner sliding sash is provided on the inside of the right jamb 30, and a right-jamb vertical tight material fitting groove 32 is provided on an indoor side wall of this right jamb recess portion 31 and a right-jamb vertical tight material 33 is disposed in the right-jamb vertical tight material fitting groove 32.

Figure 11C:
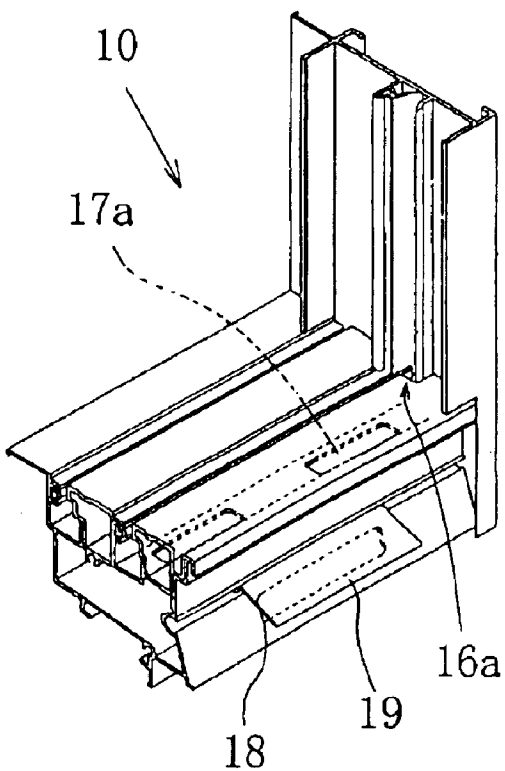
FIGS. 11A, 11B, and 11C show the layout of drain ports.
Figure 11B:
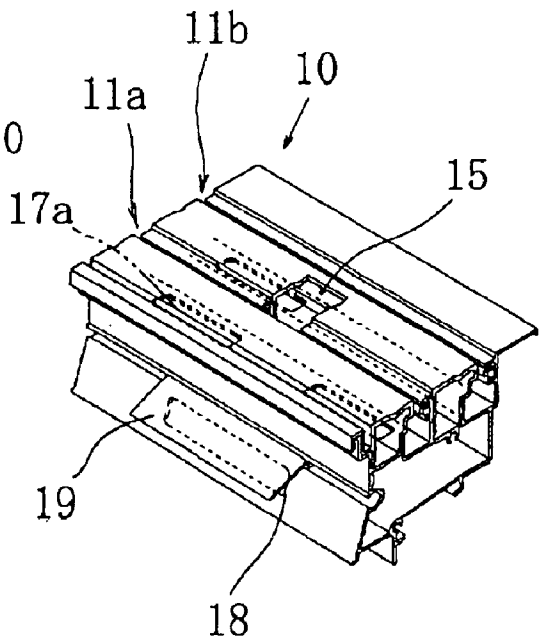
Figure 11A:
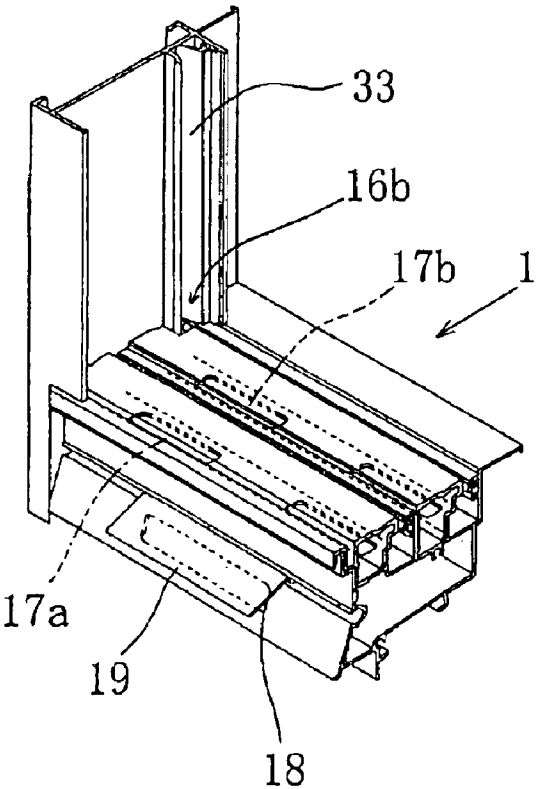

As shown in FIGS. 11A to 11C, each of the outer sliding sash and the inner sliding sash is disposed so that the sealing surface of the horizontal tight material for the slide portion and thus sealing surface of the vertical tight material for the stopper stile are approximately flush with each other. Accordingly, both sliding surfaces can effect a stable and reliable sealing function against wind pressure or the adjustment of the opening/closing smoothness of the sliding sashes, thereby preventing rainwater or the like from leaking indoors.

It is to be noted that in the invention, the sealing surface of the horizontal tight member and the sealing member of the vertical tight member need only be formed to be approximately flush with each other, and such tight members may be disposed to either of a sash and a frame, and either construction is selectively adopted.

In a sliding sash mating section, as shown in FIG. 10, an outer sliding sash contact portion 53*a* provided in the outer sliding sash mating stile 53 of the outer sliding sash 50 and an inner sliding sash contact portion 63*a* provided in the inner sliding sash mating stile 63 of the inner sliding sash 60 are placed in contact with each other when both sliding sashes are closed. A mating-stile tight material 66 is disposed in a mating-stile tight material fitting groove 63*b* provided in a mating portion of the inner sliding sash, and is in sliding contact with a side surface of the outer sliding sash.

Incidentally, this mating-stile tight material need only have airtightness and watertightness, and may also be provided on the outer sliding sash.

As shown in FIGS. 11A to 11C, the sill is provided with a flat-surface drain port 15, a left-corner-portion drain port 16*a*, a right-corner-portion drain port 16*b*, sill-drain ports 17*a* for the outer sliding sash, sill-drain ports 17*b* for the inner sliding sash, and sill outdoor drain ports 18. FIG. 11B is a perspective view of the sliding sash mating section, and FIGS. 11A and 11C are perspective views of the respective corner portions.

Incidentally, the position of the flat-surface drain port is not limited to the mating section between the inner sliding sash and the outer sliding sash, and a plurality of flat-surface drain ports may also be provided at equal intervals in the flat surface of the sill. The flat-surface drain port may also be provided irrespective of the position of a mating-stile water stopping block. However, since rainwater particularly easily concentrates in the mating section and a drain port which is provided in this section cannot be seen from the outside and is attractive in terms of its external appearance, the flat-surface drain port is provided in the mating section in the embodiment.

Wind/water backflow stopping members 19 are fitted to outside portions above the respective sill outdoor drain ports 18 in such a manner as to cover the sill outdoor drain ports 18.

Figure 12A:
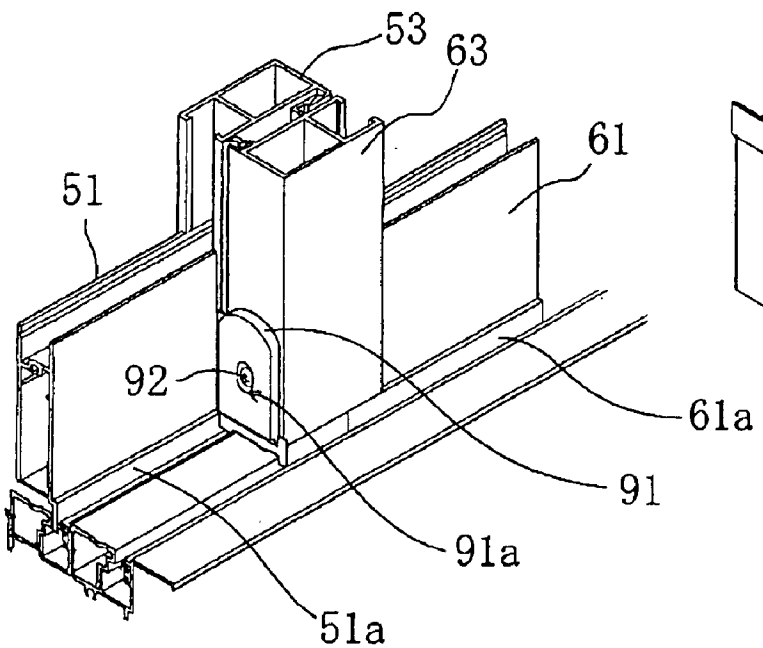
FIGS. 12A, 12B, and 12C show external perspective views of a mating portion.
Figure 12B:
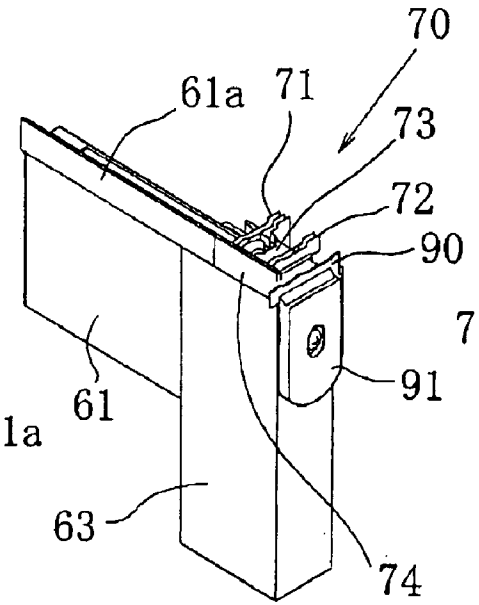
Figure 12C:
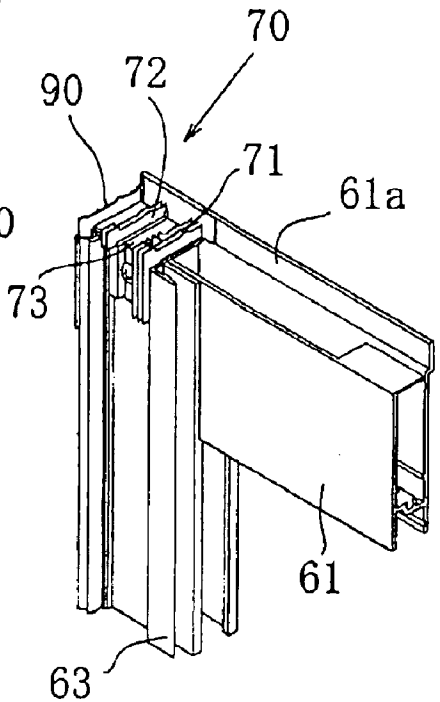

As shown in FIGS. 12A to 12C, a mating-stile water stopping block 70 is installed in the bottom of the inner sliding sash mating stile that corresponds to the flat-surface drain port, with a mating-stile water stopping block engaging member such as a machine screw.

The mating-stile water stopping block 70 has an mating-stile water stopping block base member 73 provided with a fin-shaped rain barrier 71 and a fin-shaped window barrier 72 each made of an elastic material, and both barriers 71 and 72 are disposed to come into contact with the top surface of the sill and the indoor side surface of the outer sliding sash.

Since steps such as rails which would have heretofore been required are omitted, the amount of water which is stored at the indoor side of the bottom of the double-sliding sash mating section is particularly large. Therefore, to increase the drainage of this portion and to prevent penetration of water into a room, the flat-surface drain port is provided in the sill at a location corresponding to the position of mating between the outer sliding sash and the inner sliding sash, and the mating-stile water stopping block disposed to the bottom of the inner sliding sash mating stile is provided with the fin-shaped rain barrier and the fin-shaped window barrier each made of an elastic material. Accordingly, when rainwater rapidly flows on the sill flat surface under wind pressure toward the mating section between the inside and outer sliding sashes, the force of rainwater flow is restrained by the fin-shaped rain barrier made of an elastic material provided on the mating-stile water stopping block. In addition, the bottom of the mating stile and the flat surface of the sill are shielded by the fin-shaped window barrier made of an elastic material, whereby the airtightness of the mating section is ensured and the fall and drain of rainwater into the flat-surface drain port provided between the rain barrier and the window barrier is promoted.

As shown in FIGS. 12A to 12C, a fin-shaped water barrier 90 made of an elastic material such as rubber is installed on a sliding-direction side wall of the inner sliding sash mating stile by a water barrier fixing member 92 via a water barrier securing member 91.

Figures 14A, 14B, 14C:
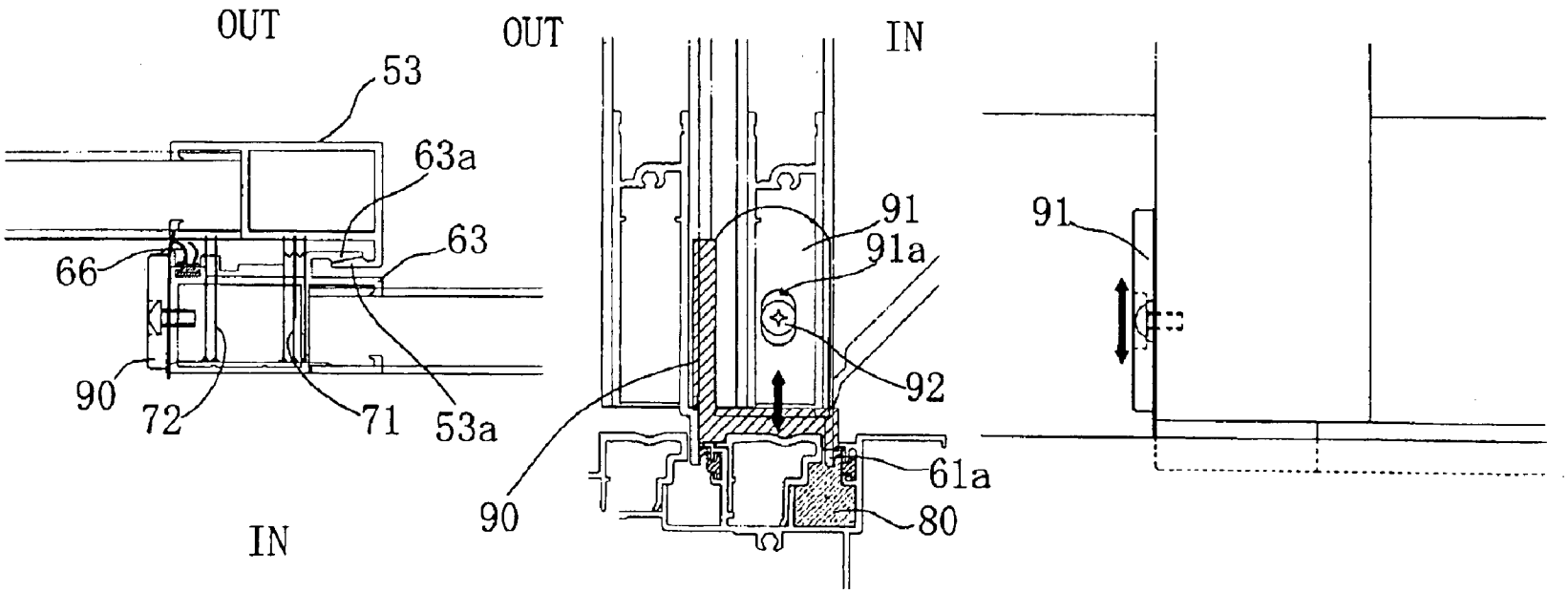
FIGS. 14A, 14B, and 14C show the positional relationship between a mating-portion water stopping block and a water barrier.

The fin-shaped water barrier 90 has a structure in which a slot-shaped water barrier securing hole 91*a* is provided in the resin-made water barrier securing member 91 so the positional relationship of the water barrier 90 can be adjusted by being slid up or down as shown in FIGS. 14B and 14C. After the water barrier has been adjusted to come into contact with the approximately flat surface of the sill and the water stopping block of the sill water collecting groove by being moved up and down in contact with the side wall of the bottom rail of the outer sliding sash, the water barrier is fixed by the water barrier fixing member 92.

Accordingly, when rainwater rapidly flows under wind pressure into the mating section, the flow of the rainwater is restrained by the mating-stile water stopping block and is drained. Since the water barrier is disposed at the indoor side of the mating-stile water stopping block, the sealing line of the mating section has a triple structure, whereby it is possible to reliably prevent water from leaking indoors.

In the inside-and-outer sliding sashes mating section of the sill water collecting groove for the inner sliding sash, as shown in FIGS. 10 and 14B, a sill water collecting groove water block 80 made of resin is provided on a water stopping line for the inner sliding sash and in the sill water collecting groove for the outer sliding sash at a location approximately corresponding to the position of the mating section between the inner sliding sash and the outer sliding sash so that the sill water collecting groove water block 80 covers the shape of the sill water collecting groove for the outer sliding sash. Accordingly, the sill water collecting groove water block 80 prevents rainwater from flowing into the indoor side of the outer sliding sash along the sill water collecting groove for the outer sliding sash.

Figure 13:
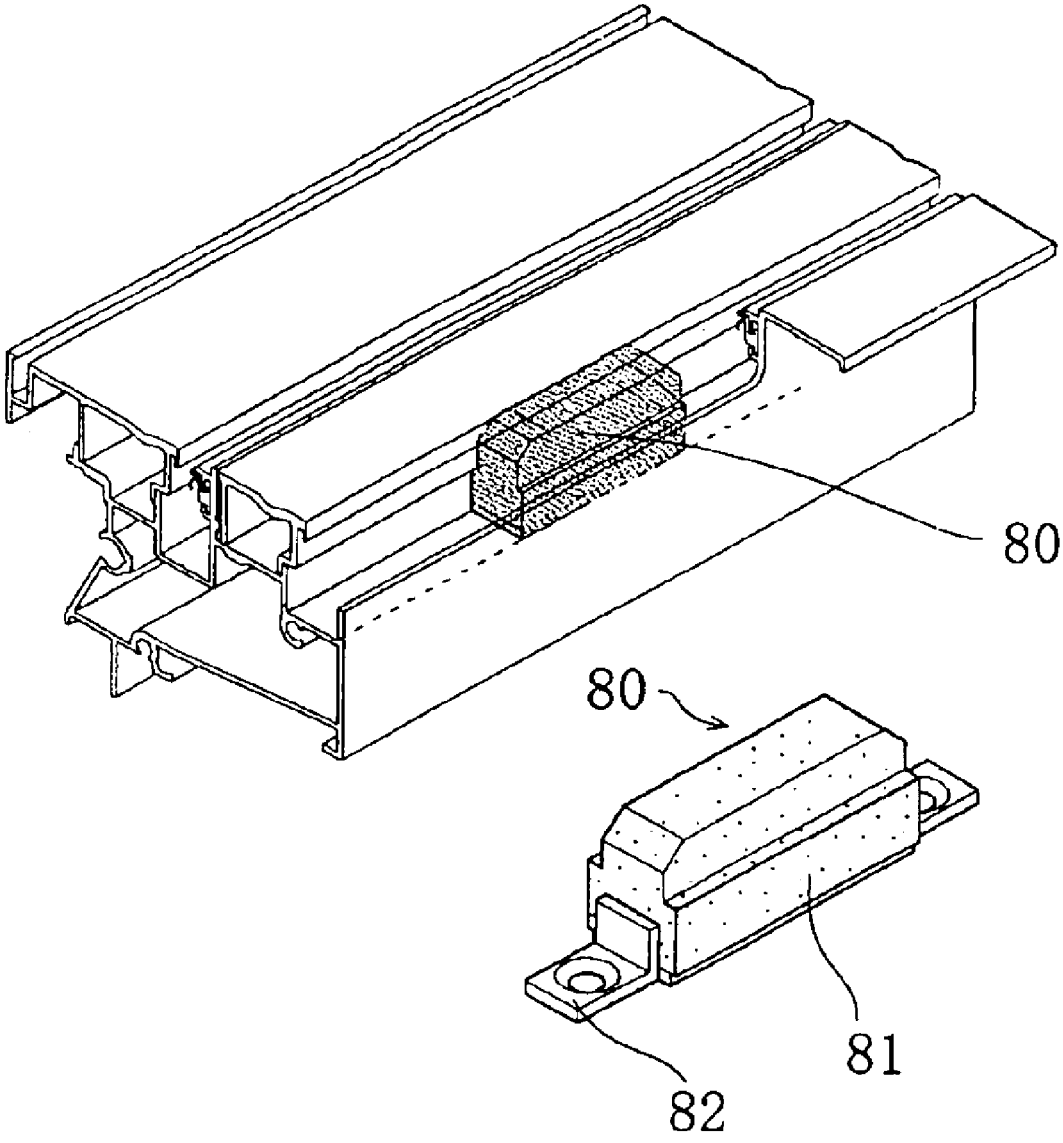
FIG. 13 shows a water stopping block for an inner sliding sash water collecting groove.

As shown in perspective in FIG. 13, this sill water collecting groove water block 80 includes a water stopping block elastic body 81 fixed to a water stopping block securing part 82, and is installed to the bottom of the sill water collecting groove by water stopping block fixing members such as machine screws.

In addition, as shown in FIG. 14B, the water stopping block elastic body 81 of the sill water collecting groove water block is inserted in the sill water collecting groove to fit the depth and the width thereof, and is in sliding contact with the inner sliding sash slide portion 61*a*.

As shown in FIGS. 11A to 11C, the flat-surface drain port 15 of the sill communicates with outside air via the sill-drain ports 17*a* for the outer sliding sash and the sill outdoor drain ports 18.

As shown in a top plan view of FIG. 14A, the top of the flat-surface drain port communicates with a space which is formed by the outer sliding sash mating stile 53, the inner sliding sash mating stile 63, the outer sliding sash contact portion 53*a* and the inner sliding sash contact portion 63*a* (smoke returning portion) provided in the respective mating stiles 53 and 63, and the mating-stile tight material 66.

An example in which the preferred embodiment of the invention is applied to an outside-sash sliding type of a single sliding sash in which an inner sliding sash portion is constructed as a stationary member having a glass plate disposed in a fixed manner and an outer sliding sash is slidably disposed will be described below. However, the invention can also be similarly applied to an inside-sash sliding type of single-sliding window and a single-sliding window in which a stationary sash is replaced by a sash accommodating portion provided in a building.

Figure 15:
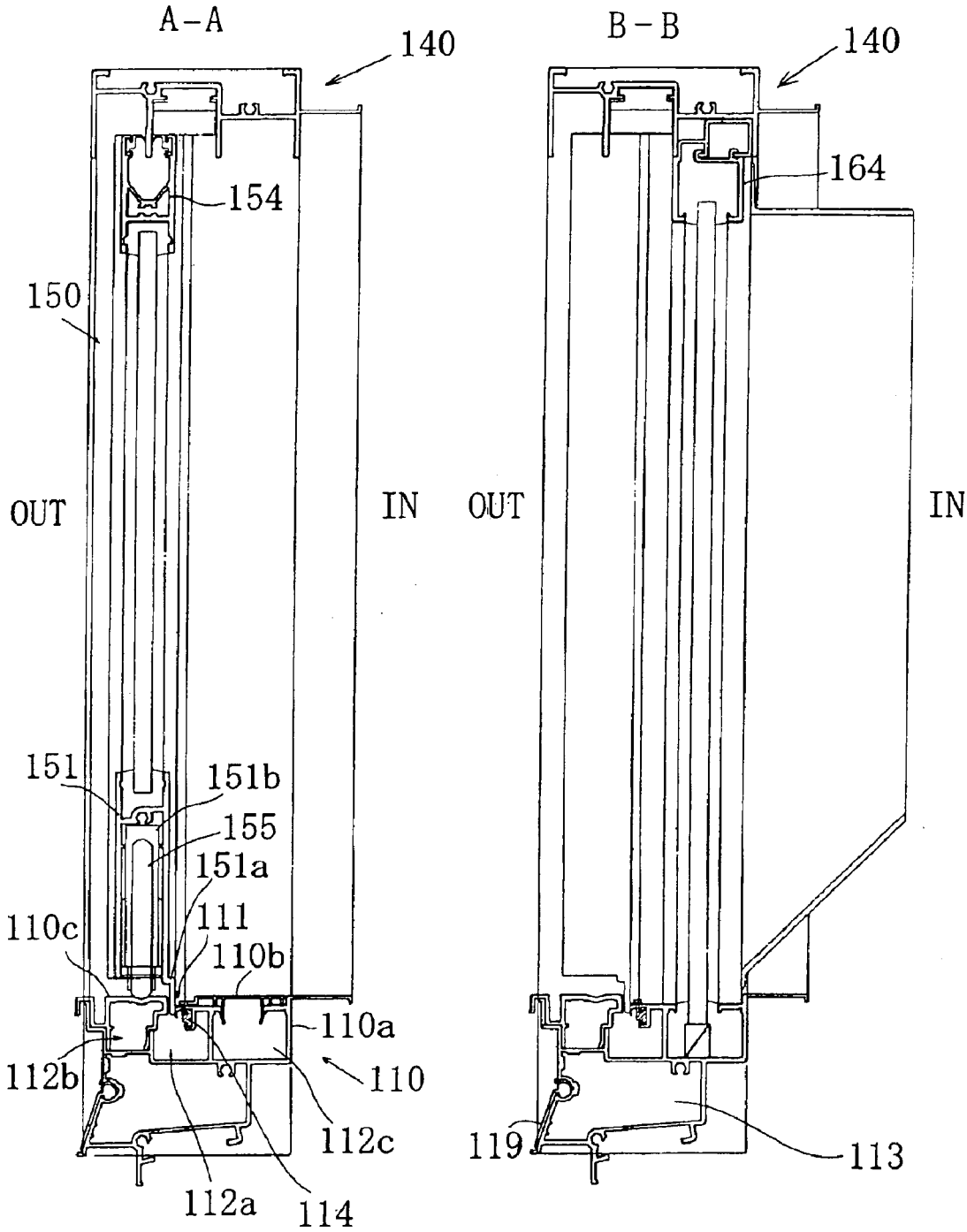
FIG. 15 shows a cross sectional view of a single-sliding window to which the invention is applied.
Figure 16:
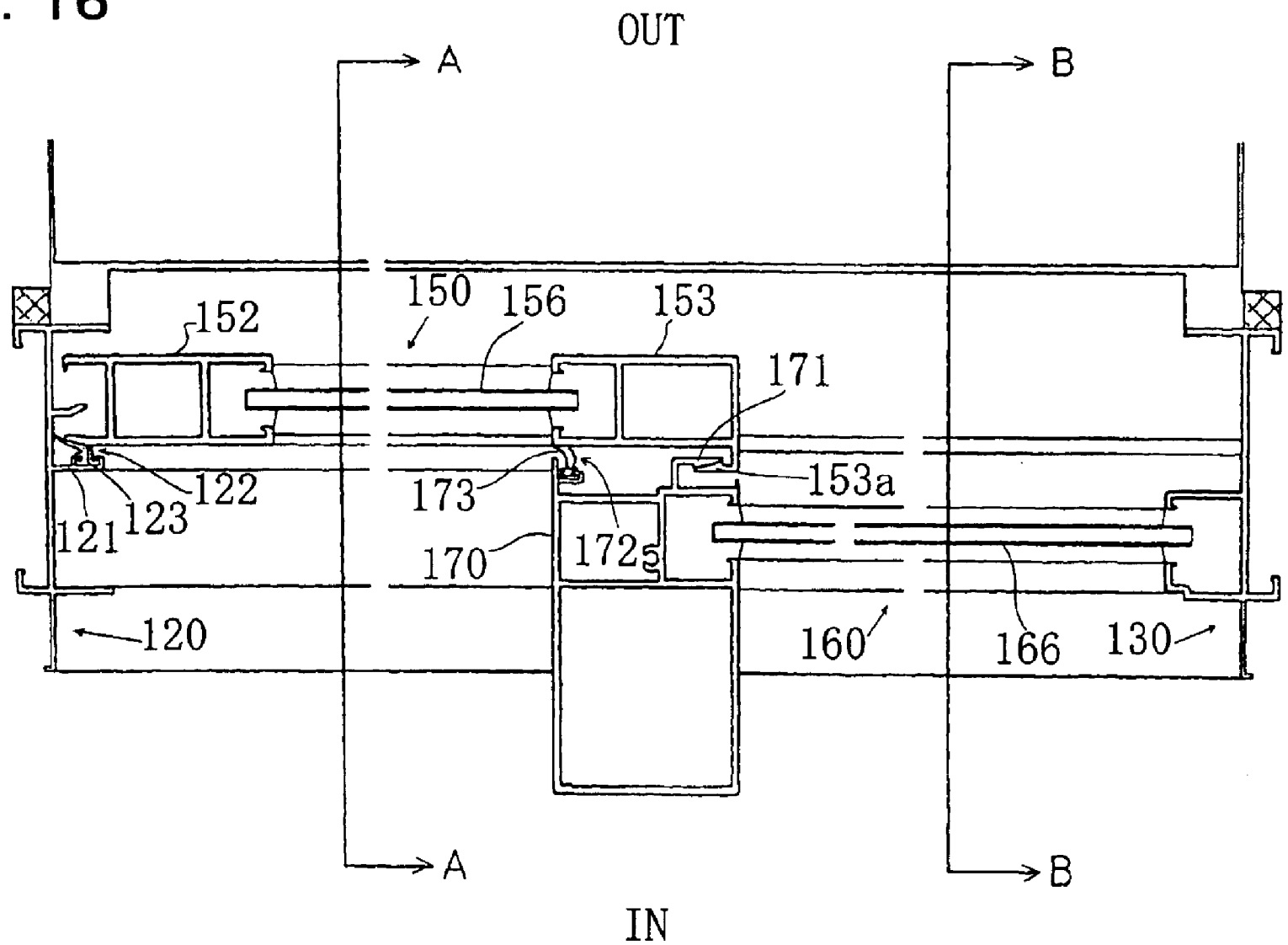
FIG. 16 shows a horizontal sectional view of the single-sliding window to which the invention is applied.

FIG. 16 shows a horizontal sectional view of an outside-sash sliding type of single-sliding window, and FIG. 15 shows cross sectional views of the same. A cross sectional view taken along the line A—A shows a slidable sash, while another cross sectional view taken along the line B—B shows a fixed sash.

A window frame is formed in a rectangular shape including a sill 110, a head 140, a left jamb 120 and a right jamb 130 as viewed from an indoor side.

A slidable sash 150 is slidably placed to the outdoor side of this frame, and a stationary sash 160 is fixed to the indoor side of the same.

The slidable sash 150 has a frame which is formed by a sliding sash bottom rail 151, a sliding sash top rail 154, a sliding sash stopper stile 152 and a sliding sash mating stile 153, and a glass plate 156 or the like is fitted to the inside of the slidable sash 150.

The stationary sash is of a so-called fixed type which is formed by the sill 110, a fixed-sash top rail 164, the right jamb 130 and a vertical bone 170, and a glass plate 166 is fitted to the stationary sash.

A sliding sash slide portion 151*a* is extended vertically downwardly at a sliding sash bottom rail 151 of the slidable sash 150, and sliding sash wheels 155 are disposed in a bottom-rail groove portion 151*b* of the slidable sash so that the slidable sash travels along a guide line on the approximately flat surface of the sill 110.

The sill 110 is provided with a sill water collecting groove 112*a* which has a sliding sash slide groove 111 in which the sliding sash slide portion 151*a* extended vertically downwardly at the sliding sash bottom rail is slidably disposed. A horizontal tight material fitting groove is provided on the indoor-side wall surface of this sill water collecting groove, and a horizontal tight material 114 is disposed in the fitting groove in sliding contact with the sliding sash slide portion 151*a*.

The sill 110 has a construction in which a sill base member 110*a* having a guiding hollow portion 113 formed by extrusion using aluminum alloy or the like, a panel strip 110*b* and a top surface member 110*c* are combined together by fitting or with machine screws or the like.

Since the top surface member is separately disposed, it is possible to easily perform the working of drain ports of the sill base member and the replacement of the tight member, and it is also possible to replace the top surface member according to the presence or absence of a screen door. Accordingly, it is possible to select and secure various top surface members which are fitted to different sliding sash slide groove widths of the sill according to various uses such as the case in which when a heavy sliding sash of pair glass specifications is to be disposed, a corresponding thick-walled sliding sash slide portion is needed or a horizontal tight material needs to be provided on the sliding sash slide portion.

Namely, the sill 110 has a structure which can cope with different uses by combining various top surface members with one kind of sill base member.

Incidentally, since a sill groove portion 112*c* into which to fit a glass plate for a fixed portion is needed in the case where the sill is formed of an aluminum-based material, the panel strip 110*b* is disposed by fitting or machine screws to cover a corresponding groove portion of an opening along which a sliding sash runs.

Figure 17B:
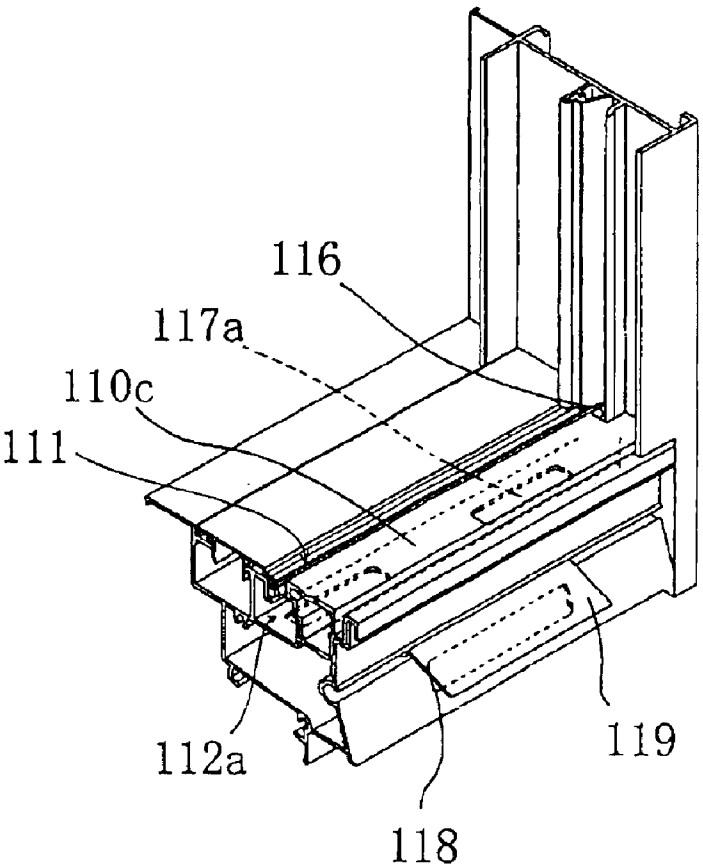
FIGS. 17A and 17B show perspective views of a mating portion and a corner portion.
Figure 17A:
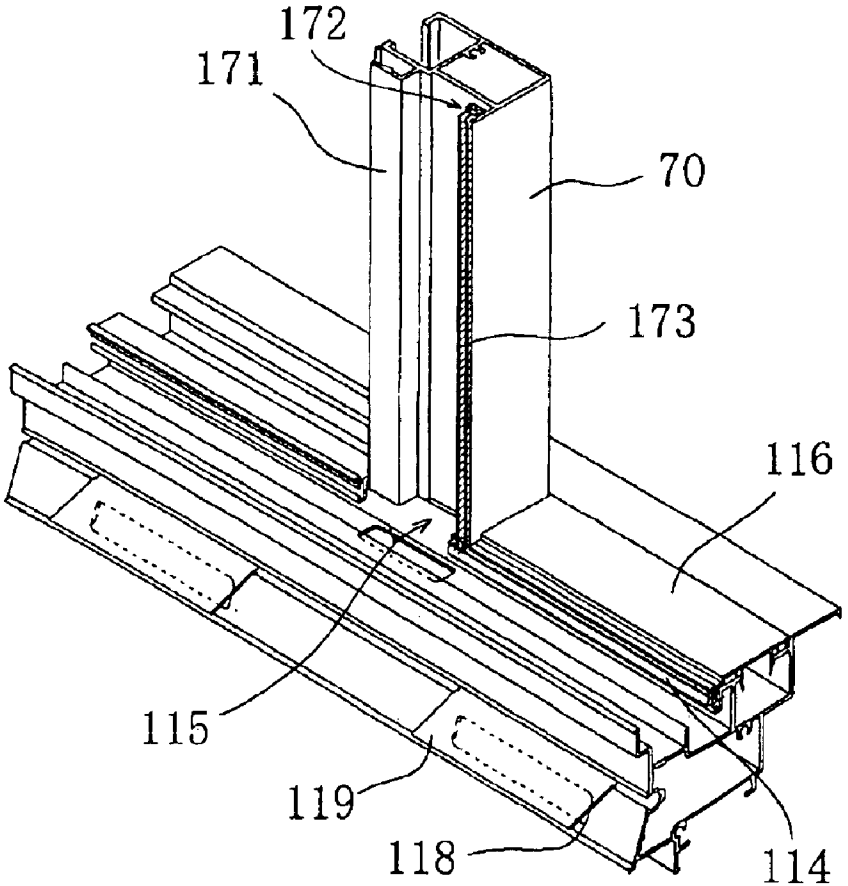

In addition, as shown in FIGS. 17A and 17B, a vertical tight material fitting groove 172 is provided on an outdoor side surface of a vertical bone extended vertically between the head and the sill in the middle of the frame as viewed from the front side thereof, and a vertical tight material 173 is disposed in the vertical tight material fitting groove 172 to form a vertical sealing line.

The vertical tight material aims to form the vertical sealing line between the bone and the sliding sash mating stile, and need not necessarily be placed on the bone and may also be disposed on the sliding sash.

As shown in FIG. 16, the left jamb 120 is provided with an engaging portion 121 for engagement with the sliding sash stopper stile 152, and a vertical tight material 123 is disposed in a vertical tight material fitting groove 122 provided in this engaging portion, to form a vertical sealing line.

The flow of drain rainwater will be described below. FIG. 17A shows a perspective view of the sill of the sliding sash mating section (in which the top surface member 110*c* of the sill is omitted for ease of understanding) and FIG. 17B shows a perspective view of the sill corner portion of the stopper stile. As shown, rainwater which flows on the flat surface of the sill top surface flows into the sill water collecting groove 112*a* through the slide groove 111, and then flows into the guiding hollow portion of the sill base member 110*a* from drain ports 117*a* provided in the sill water collecting groove and flows outdoors from sill outdoor drain ports 118.

Incidentally, wind/water backflow stopping members 119 are fitted to outside portions above the respective sill outdoor drain ports 118 in such a manner as to cover the sill outdoor drain ports 118.

Rainwater which enters from a contact portion 171 of the vertical bone 170 is drained from a flat-surface drain port 115, and is also drained from a corner-portion drain port 116 provided in the stopper-stile corner portion.

INDUSTRIAL APPLICABILITY

Since the invention resides in a window which prevents rainwater from entering indoors under wind pressure, the invention is most effectively applied to windows which are provided in the outdoor openings of high-rise houses such as building houses or the like. In addition, the invention can provide higher airtightness and water tightness far higher than would have heretofore been obtained, low-rise houses such as detached houses.

What is claimed is:

1. An outdoor window comprising:

a window frame including a head, a sill having a flat top surface, and side jambs, wherein the window frame is disposed in an opening of a building which separates an indoor side and an outdoor side of the window frame;

a sliding sash positioned inside the window frame to open and close the opening of the building;

a drain groove provided on the flat top surface of the sill, the drain groove having an indoor wall and an outdoor wall defining a predetermined width therebetween;

a water collecting groove provided immediately below the drain groove, the water collecting groove having a width wider than the width of the drain groove;

a slide portion extending vertically downward from an indoor side wall of a bottom rail of the sliding sash to form a predetermined gap between an outdoor side of the slide portion and the outdoor wall of the drain groove; and a sealing member provided on the indoor wall of the drain groove in sliding contact with the slide portion;

wherein a portion of the sealing member is pressed by the slide portion when a wind pressure is applied to the sliding sash from the outdoor side of the window frame, so that rainwater is drained through the drain groove.

2. An outdoor window, comprising:

a window frame including a head, a sill having a flat top surface, and side jambs, wherein the window frame is disposed in an opening of a building which separates an indoor side and an outdoor side of the window frame;

a sliding sash positioned inside the window frame to open and close the opening of the building;

a drain groove provided on the flat top surface of the sill, the drain groove having an indoor wall and an outdoor wall defining a predetermined width therebetween;

a water collecting groove provided immediately below the drain groove, the water collecting groove having a width wider than the width of the drain groove;

a drain port provided at a bottom of the water collecting groove;

a guiding hollow portion which communicates with outside air immediately below the drain port;

a slide portion extending vertically downward from an indoor side wall of a bottom rail of the sliding sash to form a predetermined gap between an outdoor side of the slide portion and the outdoor wall of the drain groove; and a sealing member provided on the indoor wall of the drain groove in sliding contact with the slide portion;

wherein a portion of the sealing member is pressed by the slide portion when a wind pressure is applied to the sliding sash from the outdoor side of the window frame, so that rainwater is drained through the drain groove and guided outdoors by the guiding hollow portion.

3. An outdoor window comprising:

a window frame including a head, a sill having a flat top surface, and side jambs, wherein the window frame is disposed in an opening of a building which separate an indoor side and an outdoor side of the window frame;

an inner sliding sash and an outer sliding sash positioned inside the window frame to open and close the opening of the building, wherein both the inner sliding sash and outer sliding sash have side stiles;

a first drain groove provided on the flat top surface of the sill, the first drain groove having an indoor wall and an outdoor wall defining a predetermined width therebetween;

a second drain groove provided on the flat top surface of the sill, the second drain groove having an indoor wall and an outdoor wall defining a predetermined width therebetween;

a first water collecting groove provided immediately below the first drain groove, the first water collecting groove having a width wider than the width of the first drain groove;

a second water collecting groove provided immediately below the second drain groove, the second water collecting groove having a width wider than the width of the second drain groove;

a slide portion extending vertically downward from an indoor side wall of a bottom rail of the inner sliding sash to form a predetermined gap between an outdoor side of the slide portion and the outdoor wall of the first drain groove;

a slide portion extending vertically downward from an indoor side wall of a bottom rail of the outer sliding sash to form a predetermined gap between an outdoor side of the slide portion and the outdoor wall of the second drain groove;

a first sealing member provided between the slide portion of the inner sliding sash and a side wall of the first water collecting groove;

a second sealing member provided between the slide portion of the outer sliding sash and the side wall of the second water collecting groove;

a third sealing member provided between the side stiles of each of the inner sliding sash and the outer sliding sash and the respective side jambs of the window frame;

a fourth sealing member provided between a sliding sash mating portion and the flat top surface of the sill, the fourth sealing member separates the indoor side and the outdoor side of the window frame;

a water stopping block provided in the first water collecting groove below an inner sliding sash mating portion;

a first drain port provided at a bottom of the first water collecting groove;

a second drain port provided at a bottom of the second water collecting groove;

a guiding hollow portion provided immediately below the first and second drain ports; and an outdoor drain port provided in the outdoor side of the guiding hollow portion;

wherein the first sealing member, second sealing member and third sealing member are pressed when a wind pressure is applied to the sliding sashes from the outdoor side, and the water collecting groove and the guiding hollow portion communicate with outside air.

4. An outdoor window, comprising:

a window frame including a head, a sill having a top surface, side jambs, and a vertical bone disposed vertically between the head and the sill, the window frame forms a building opening and a sliding sash accommodating portion;

an outdoor sliding sash slidably disposed between the head and the sill;

a drain groove provided on the flat top surface of the sill, the drain groove having an indoor wall and an outdoor wall defining a predetermined width therebetween;

a water collecting groove provided immediately below the drain groove, the water collecting groove having a width wider than the width of the drain groove;

a slide portion extending vertically downward from an indoor side wall of a bottom rail of the sliding sash to form a predetermined gap between an outdoor side of the slide portion and the outdoor wall of the drain groove;

a first sealing member provided between the slide portion and an indoor wall of the water collecting groove;

a second sealing member provided between the vertical bone and a sliding sash mating stile and between a sliding sash stopper stile and the side jamb;

a drain port provided at a bottom of the water collecting groove;

a guiding hollow portion provided immediately below the drain port; and an outdoor drain port provided in an outdoor side of the guiding hollow portion;

wherein the first sealing member is pressed when a wind pressure is applied to the sliding sash from an outdoor side and the water collecting groove and the guiding hollow portion communicate with outside air so that rainwater is guided outdoors.

* * * * *